US008435132B2

(12) United States Patent
Oldknow et al.

(10) Patent No.: US 8,435,132 B2
(45) Date of Patent: May 7, 2013

(54) GOLF CLUBS AND GOLF CLUB HEADS

(75) Inventors: Andrew G. V. Oldknow, Portland, OR (US); John T. Stites, Weatherford, TX (US)

(73) Assignee: Nike, Inc., Beaverton, OR (US)

( * ) Notice: Subject to any disclaimer, the term of this patent is extended or adjusted under 35 U.S.C. 154(b) by 187 days.

(21) Appl. No.: 12/500,793

(22) Filed: Jul. 10, 2009

(65) Prior Publication Data

US 2011/0009205 A1 Jan. 13, 2011

(51) Int. Cl.
*A63B 53/04* (2006.01)

(52) U.S. Cl.
USPC ..... 473/291; 473/349; 473/350

(58) Field of Classification Search ..... 473/290–291, 473/350, 349; D21/747, 748
See application file for complete search history.

(56) References Cited

U.S. PATENT DOCUMENTS

| | | | | | |
|---|---|---|---|---|---|
| 3,655,188 | A | * | 4/1972 | Solheim | 473/290 |
| 4,645,207 | A | * | 2/1987 | Teramoto et al. | 473/290 |
| 4,811,950 | A | * | 3/1989 | Kobayashi | 473/335 |
| 4,919,430 | A | | 4/1990 | Antonious | |
| 5,014,993 | A | * | 5/1991 | Antonious | |
| 5,026,056 | A | | 6/1991 | McNally et al. | |
| 5,046,733 | A | | 9/1991 | Antonious | |
| 5,290,032 | A | * | 3/1994 | Fenton et al. | 473/290 |
| 5,328,184 | A | | 7/1994 | Antonious | |
| 5,439,223 | A | * | 8/1995 | Kobayashi | 473/334 |
| 5,524,880 | A | * | 6/1996 | Kobayashi | 473/291 |
| 5,549,297 | A | * | 8/1996 | Mahaffey | 473/290 |
| 5,674,133 | A | * | 10/1997 | Chang et al. | 473/291 |
| 5,722,900 | A | * | 3/1998 | Sung | 473/291 |
| 6,015,354 | A | * | 1/2000 | Ahn et al. | 473/256 |
| 6,379,262 | B1 | | 4/2002 | Boone | |
| 6,454,665 | B2 | | 9/2002 | Antonious | |
| 6,695,937 | B1 | * | 2/2004 | Stites, III | 148/577 |
| 7,022,028 | B2 | * | 4/2006 | Nagai et al. | 473/291 |
| 8,025,589 | B2 | * | 9/2011 | Brinton et al. | 473/290 |
| 2001/0001774 | A1 | * | 5/2001 | Antonious | 473/349 |
| 2003/0199331 | A1 | * | 10/2003 | Stites, III | 473/290 |
| 2004/0018890 | A1 | | 1/2004 | Stites et al. | |
| 2005/0085312 | A1 | * | 4/2005 | Nagai et al. | 473/291 |
| 2006/0172822 | A1 | | 8/2006 | Liang et al. | |
| 2007/0207878 | A1 | | 9/2007 | Tavares et al. | |
| 2008/0020861 | A1 | * | 1/2008 | Adams et al. | 473/334 |

OTHER PUBLICATIONS

International Search Report and Written Opinion issued in corresponding PCT/US2010/040941 dated Nov. 26, 2010.

* cited by examiner

*Primary Examiner* — Stephen L. Blau
(74) *Attorney, Agent, or Firm* — Banner & Witcoff, Ltd.

(57) ABSTRACT

Golf club heads are provided which include an iron type golf club head body including a ball striking face, a rear surface opposite the ball striking face (e.g., including a perimeter weighting member) and an weight member which is shaped and/or positioned to selectively control features of the golf club head. Golf clubs including these club heads and methods of making such golf club and golf club heads also are provided.

12 Claims, 12 Drawing Sheets

GOLF CLUBS AND GOLF CLUB HEADS

FIELD OF THE DISCLOSURE

The present disclosure relates to golf clubs and golf club heads. Particular example aspects of this disclosure relate to golf clubs and golf club heads having weight members which are shaped and/or positioned to selectively control features of the golf club head.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

While the industry has witnessed dramatic changes and improvements to golf equipment in recent years, there is room in the art for further advances in golf club technology.

SUMMARY OF THE DISCLOSURE

The following presents a general summary of aspects of the disclosure in order to provide a basic understanding of the disclosure and various aspects of it. This summary is not intended to limit the scope of the disclosure in any way, but it simply provides a general overview and context for the more detailed description that follows.

Golf club heads according to at least some example aspects of this disclosure include: an iron-type golf club head body having a ball striking face and a rear surface opposite the ball striking face (e.g., including a perimeter weighting member extending rearward from the ball striking face and along at least a portion of a circumferential area of the golf club head body). Also, the golf club head body may include a weight member which is selectively shaped and/or selectively positioned to redistribute the mass and weight of the golf club head body.

According to some aspects of this disclosure, a weight member's shape and/or its positioning relative to the golf club head body can be used to alter the center of the gravity of the club head body. For example, due to the weight member's weighting characteristics (weight, density, etc.), the shape of the weight member, the position of the weight member relative to the golf club head body, or both will redistribute the mass and weight of the golf club head body and thereby shift the club head body's center of gravity. Therefore, the weight member can be selectively shaped, selectively positioned, or both to control features of the club head body's center of gravity. According to some aspects of this disclosure, the weight member can be selectively shaped, selectively positioned, or both to shift the club head body's center of gravity in a vertical, horizontal and/or a depth direction.

Additional aspects of this disclosure relate to golf club structures that include golf club heads, e.g., of the types described above. Such golf club structures further may include one or more of: a shaft member attached to the club head (optionally via a separate hosel member or a hosel member provided as an integral part of one or more of the club head or shaft); a grip or handle member attached to the shaft member; additional weight members; etc.

Additional aspects of this disclosure relate to a set of golf clubs that includes golf club head bodies such as those described above which have varying centers of gravity depending on the particular club head body. Further, in accordance with at least some examples of this disclosure, the weight members may be selectively shaped and/or positioned relative to the golf club head bodies to provide a set of golf clubs wherein the club head bodies with a low degree of loft relative to the set of club head bodies (i.e., "long" irons) have a center of gravity closer to a hosel of the club head body than the toe of the club head body and, conversely, club head bodies with a high degree of loft relative to the set of club head bodies (i.e., "short irons") have a center of gravity closer to a toe of the club head body than the heel of the club head body.

Still additional aspects of this disclosure relate to methods for producing golf club heads and golf club structures, e.g., of the types described above. Such methods may include, for example: (a) providing a golf club head of the various types described above, e.g., by manufacturing or otherwise constructing the golf club head body, by obtaining the golf club head body from another source, etc.; and (b) engaging a shaft member with the golf club head. Other steps also may be included in these methods, such as engaging a grip member with the shaft member, club head body finishing steps, etc.

BRIEF DESCRIPTION OF THE DRAWINGS

The present disclosure is illustrated by way of example and not limited in the accompanying figures, in which like reference numerals indicate similar elements throughout, and in which.

Figure 1:
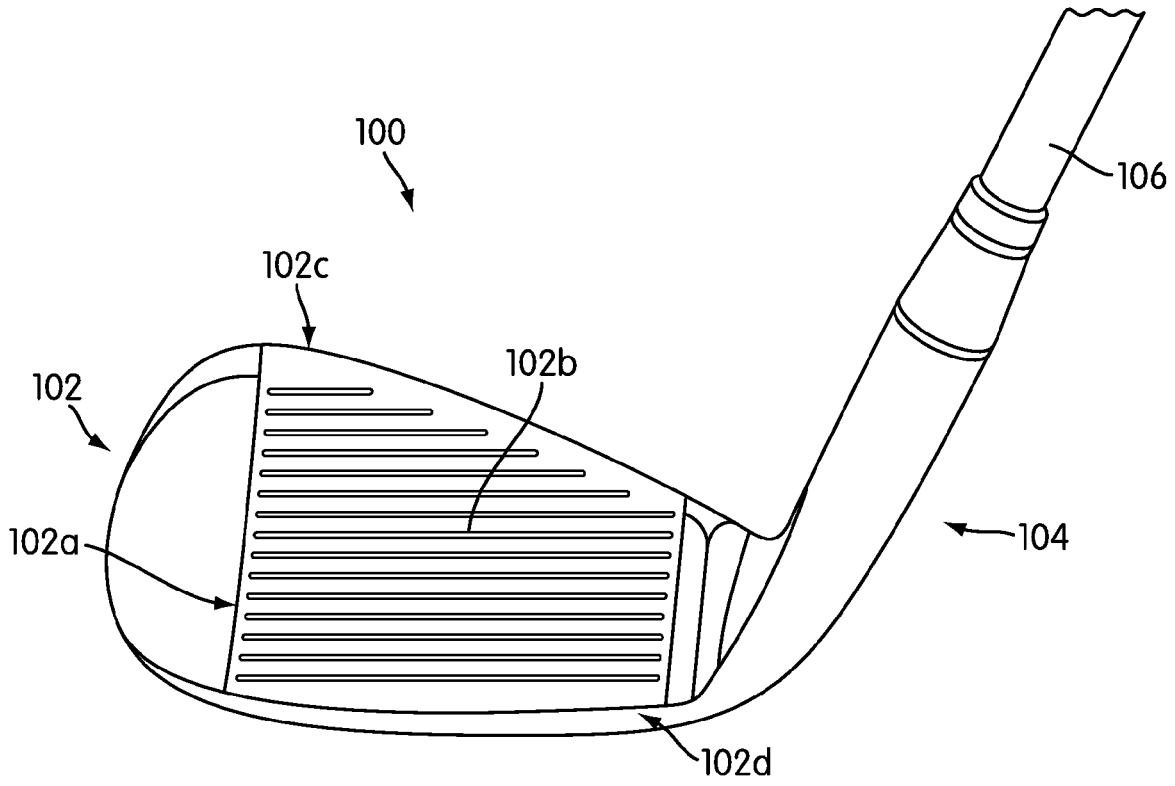
FIG. 1 generally illustrates features of a golf club structure according to at least some examples of this disclosure.

The reader is advised that the various parts shown in these drawings are not necessarily drawn to scale.

DETAILED DESCRIPTION

The following description and the accompanying figures disclose features of golf club heads and golf clubs in accordance with examples of the present disclosure.

I. General Description of Example Golf Club Heads, Golf Clubs, and Methods in Accordance with this Disclosure As described above, aspects of this disclosure relate to iron-type golf club heads and golf clubs. Iron-type golf club heads according to at least some example aspects of this disclosure may include: (a) an iron-type golf club head body; (b) a ball striking face; (c) a rear surface opposite the ball striking face, optionally including a perimeter weighting member extending rearward from the ball striking face and along at least a portion of a circumferential area of the golf club head body; and (d) a weight member which is selectively shaped and/or selectively positioned to redistribute the mass and weight of the golf club head body.

Therefore, according to aspects of this disclosure, the weight member (or the weight member portions which make up the weight member) may affect the location of the center of gravity of the golf club head body. For example, the weight member may have a different weight, different density, different weight distribution, and/or other different weighting characteristics relative to the rest of the club head body. Therefore, providing a weight member of a particular shape or positioning a weight member in a particular location of the golf club head body will redistribute the mass and weight and, hence, shift the location of the center of gravity accordingly. In other words, the shape of the weight member or the positioning of the weight member in the club head body (or both) can be controlled in order to provide a particular center of gravity for a golf club head body. As described below, providing a particular center of gravity for a golf club head body can be advantageous.

According to some aspects of this disclosure, the weight member may be shaped and/or positioned in "long" iron type golf clubs (i.e., irons with a relatively low degree of loft, e.g., a 3-iron) to provide a center of gravity of the golf club head body which is closer to the heel of the club head body (i.e., near the hosel). Such a configuration decreases the distance from the hosel to the center of gravity of the golf club head body. Because the center of gravity is closer to the hosel, the golfer can more quickly and easily rotate the golf club head body (e.g., from an open club face position to a closed club face position). Hence, such a configuration can aid a golfer in imparting "draw" trajectory to the golf ball. A "draw" is a golf shot in which the golfer curves the ball in a direction opposite to the side from which it was struck. For example, for a right handed golfer, the golf ball will have "right to left" trajectory. The ball flight for a "draw" tends to have less backspin and, therefore, the ball tends to roll further once it lands. Also, "draws" tend to exhibit lower ball flights. These aspects of a "draw" (i.e., less backspin, further roll and lower ball flight) tend to increase the distance that the golf ball will travel upon being struck by the golfer. Therefore, providing the center of gravity of the golf club head body near the heel can increase the distance of a golf shot, which may be particularly useful in "long" irons.

According to some other aspects of this disclosure, the weight member may be shaped and/or positioned in "short" iron type golf clubs (i.e., irons with a relatively high degree of loft, e.g., a 9-iron, wedges, etc.) to provide a center of gravity of the golf club head body which is closer to the toe of the club head body. Such a configuration increases the distance from the hosel to the center of gravity of the golf club head body. Because the center of gravity is further away from the hosel, the golfer may not be able to rotate the golf club head body as quickly or easily (e.g., from an open club face position to a closed club face position). Therefore, the stability of the golf shot is increased. Hence, such a configuration can aid a golfer in imparting "fade" trajectory to the golf ball. A "fade" is a golf shot in which the golfer curves the ball a direction corresponding to the side from which it was struck. For example, for a right handed golfer, the golf ball will have "left to right" trajectory. The ball flight for a "fade" tends to have more backspin and, therefore, the ball tends to roll less once it lands. Also, "fades" tend to exhibit higher ball flights. These aspects of a "fade" (i.e., more backspin, less roll and higher ball flight) tend to stop the ball from rolling. Therefore, providing the center of gravity of the golf club head body near the toe can aid the golfer in stopping the ball from rolling when it lands on the green, which may be particularly useful in "short" irons.

According to some other aspects of this disclosure, the weight member may be shaped and/or positioned in "middle" iron type golf clubs (i.e., irons with a relatively intermediate degree of loft, e.g., a 5-iron) to provide the center of gravity of the golf club head body generally near the center of the club head body. Such a configuration can create a relatively intermediate distance from the hosel to the center of gravity of the golf club head body. Because the center of gravity is at a relatively intermediate distance from the hosel (e.g., near the center of the golf club head body) the "middle" irons will have some characteristics from each of the above described "long" and "short" irons (e.g., further distance and better ball control), but not to the same extent.

According to other aspects of this disclosure, the weight member may be selectively shaped and/or selectively positioned in iron type golf clubs to vary the position of the center of gravity of the golf club head body in the depth direction (i.e., the direction from the face of the club head body to the rear of the club head body). Varying the position of the club head body's center of gravity in the depth direction affects different characteristics of a golf club. For example, a club head body with a center of gravity relatively far from the club head's face may help a golfer get the ball in the air, while a club head body with a center of gravity closer to the face may increase the distance of a particular golf shot. Therefore, selectively shaping and/or selectively positioning the weight member to control the position of the center of gravity of the golf club head body in the depth direction can be advantageous.

Additional aspects of this disclosure relate to iron-type golf club structures that include golf club heads, e.g., of the types described above. Such iron-type golf club structures further may include one or more of: a shaft member attached to the club head (optionally via a separate hosel member or a hosel member provided as a part of one or more of the club head and/or shaft); a grip or handle member attached to the shaft member; additional weight members; medallions; etc.

Still additional aspects of this disclosure relate to methods for producing iron-type golf club heads and iron-type golf club structures in accordance with examples of this disclosure. Such methods may include, for example, one or more of the following steps in any desired order and/or combinations: (a) providing a golf club head body of the various types described above (including any or all of the various structures, features, and/or arrangements described above), e.g., by manufacturing or otherwise constructing the golf club head body, by obtaining it from a third party source, etc.; (b) engaging a shaft member with the golf club head body; and (c) engaging a grip member with the shaft member.

Given the general description of various example aspects of the disclosure provided above, more detailed descriptions of various specific examples of golf clubs and golf club head structures according to the disclosure are provided below.

II. Detailed Description of Example Golf Club Heads, Golf Club Structures, and Methods According to the Disclosure The following discussion and accompanying figures describe various example golf clubs and golf club head structures in accordance with the present disclosure. When the same reference number appears in more than one drawing, that reference number is used consistently in this specification and the drawings to refer to the same or similar parts throughout.

More specific examples and features of iron-type golf club heads and golf club structures according to this disclosure will be described in detail below in conjunction with the example golf club structures illustrated in FIGS. 1-5.

FIG. 1 generally illustrates an example of an iron-type golf club 100 and/or golf club head body 102 in accordance with the present disclosure. In addition to the golf club head body 102, the overall golf club structure 100 of this example includes a hosel region 104, a shaft member 106 received in and/or inserted into and/or through the hosel region 104, and a grip or handle member (not shown) attached to the shaft member 106. Optionally, if desired, the external hosel region 104 may be eliminated and the shaft member 106 may be directly inserted into and/or otherwise attached to the head member 102 (e.g., through an opening provided in the top of the club head body 102, through an internal hosel member (e.g., provided within an interior chamber defined by the club head body 102), etc.). The hosel member 104 may be integrally formed as part of the club head structure 102, or it may be separately formed and engaged therewith (e.g., by adhesives or cements; by welding, brazing, soldering, or other fusing techniques; by mechanical connectors; etc.). Conventional hosels and their inclusion in an iron type club head structure may be used without departing from this disclosure.

The shaft member 106 may be received in, engaged with, and/or attached to the club head body 102 in any suitable or desired manner, including in conventional manners known and used in the art, without departing from the disclosure. As more specific examples, the shaft member 106 may be engaged with the club head body 102 via a hosel member 104 and/or directly to the club head structure 102, e.g., via adhesives, cements, welding, soldering, mechanical connectors (such as threads, retaining elements, or the like), etc.; through a shaft-receiving sleeve or element extending into the club head body 102; etc. If desired, the shaft 106 may be connected to the head 102 in a releasable manner using mechanical connectors to allow easy interchange of one shaft for another on the head.

The shaft member 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member (not shown) may be attached to, engaged with, and/or extend from the shaft member 106 in any suitable or desired manner, including in conventional manners known and used in the art, e.g., using adhesives or cements; via welding, soldering, brazing, or the like; via mechanical connectors (such as threads, retaining elements, etc.); etc. As another example, if desired, the grip or handle member (not shown) may be integrally formed as a unitary, one-piece construction with the shaft member 106. Additionally, any desired grip or handle member materials may be used without departing from this disclosure, including, for example: rubber materials, leather materials, rubber or other materials including cord or other fabric material embedded therein, polymeric materials, and the like.

The club head body 102 itself also may be constructed in any suitable or desired manner and/or from any suitable or desired materials without departing from this disclosure, including from conventional materials and/or in conventional manners known and used in the art. For example, in the example structure shown in FIG. 1, the club head body 102 includes a ball striking face member 102*a* (including a ball striking face plate 102*b* integrally formed with the face member 102*a* or attached to a frame member such that the face plate 102*b* and frame member together constitute the overall face member 102*a*). The club head body 102 of this illustrated example further includes a top, or crown, portion 102*c* and a sole portion 102*d*. The club head body 102 and/or its various parts may be made by forging, casting, molding, and/or using other techniques and processes, including techniques and processes that are conventional and known in the art.

A wide variety of overall club head constructions are possible without departing from this disclosure. For example, if desired, some or all of the various individual parts of the club head body 102 described above may be made from multiple pieces that are connected together (e.g., by adhesives or cements; by welding, soldering, brazing, or other fusing techniques; by mechanical connectors; etc.). The various parts (e.g., top portion 102*c*, sole portion 102*d*, etc.) may be made from any desired materials and combinations of different materials, including materials that are conventionally known and used in the art, such as metal materials, including lightweight metal materials, composite materials, polymer materials, etc.

The dimensions and/or other characteristics of a golf club head structure 102 according to examples of this disclosure may vary significantly without departing from the disclosure. For example, any iron type club head may be provided including, for example: iron type hybrid clubs, driving irons, 0 through 10 irons, wedges (e.g., pitching wedges, lob wedges, gap wedges, sand wedges, etc.), chipping clubs, etc.

Figure 2A:
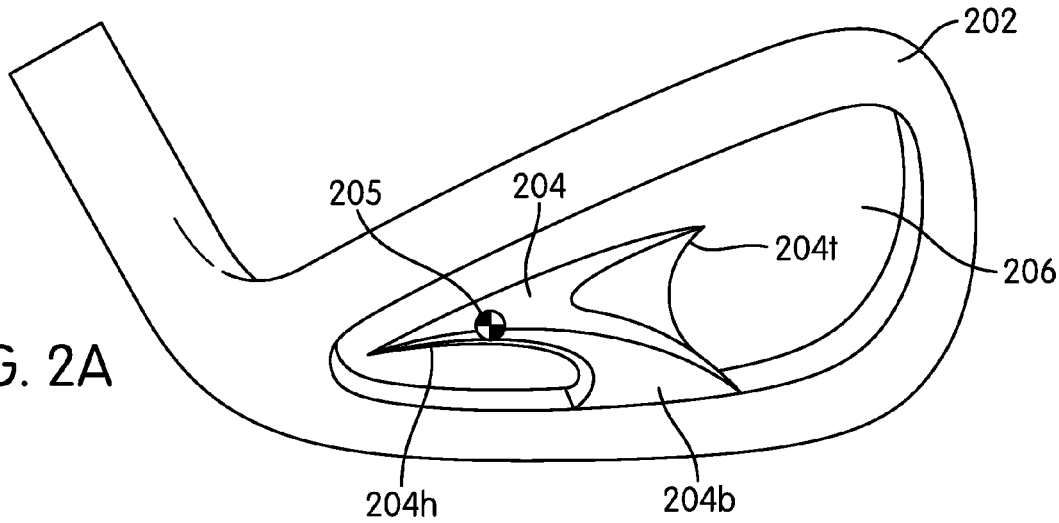
FIGS. 2A-2C illustrate a golf club head structure according to at least some examples of this disclosure.
Figure 2B:
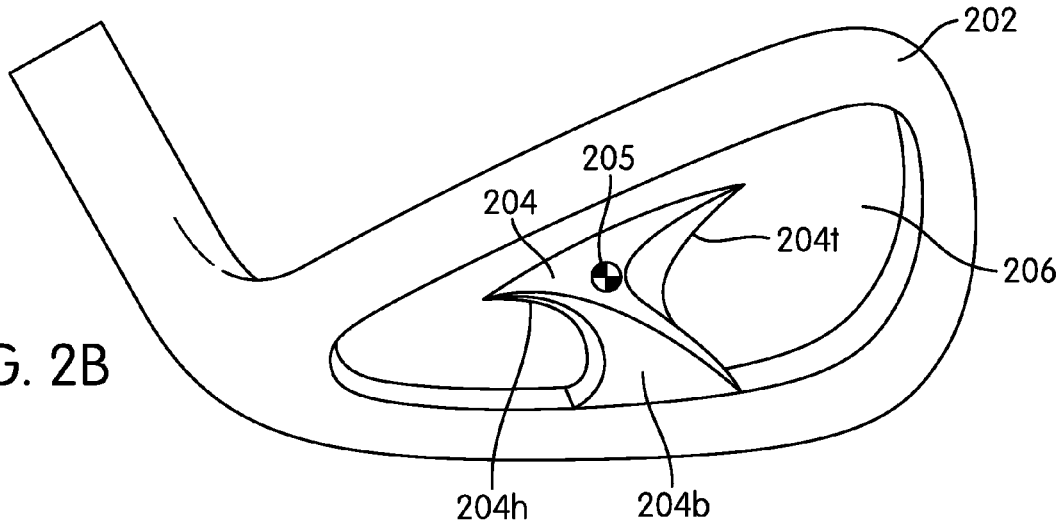
Figure 2C:
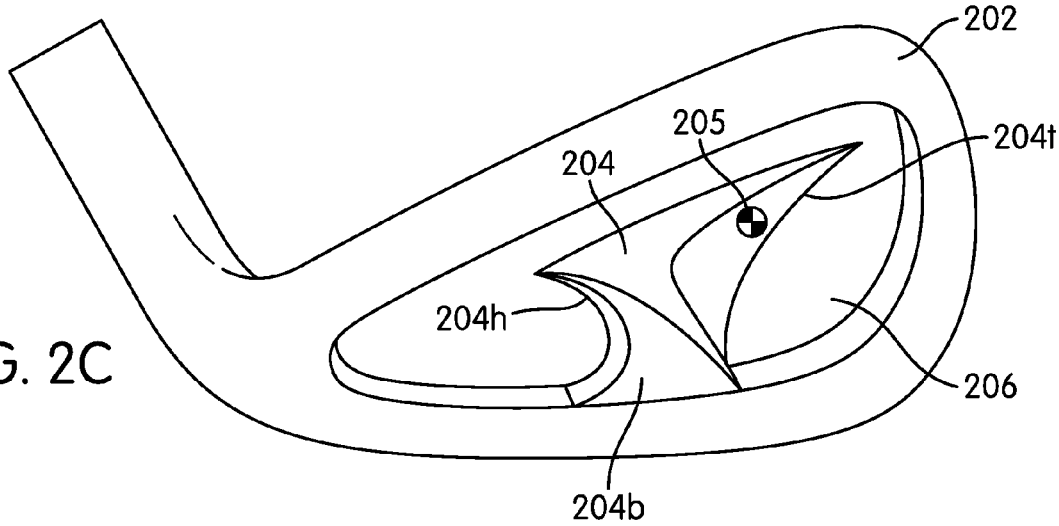
Figure 2D:
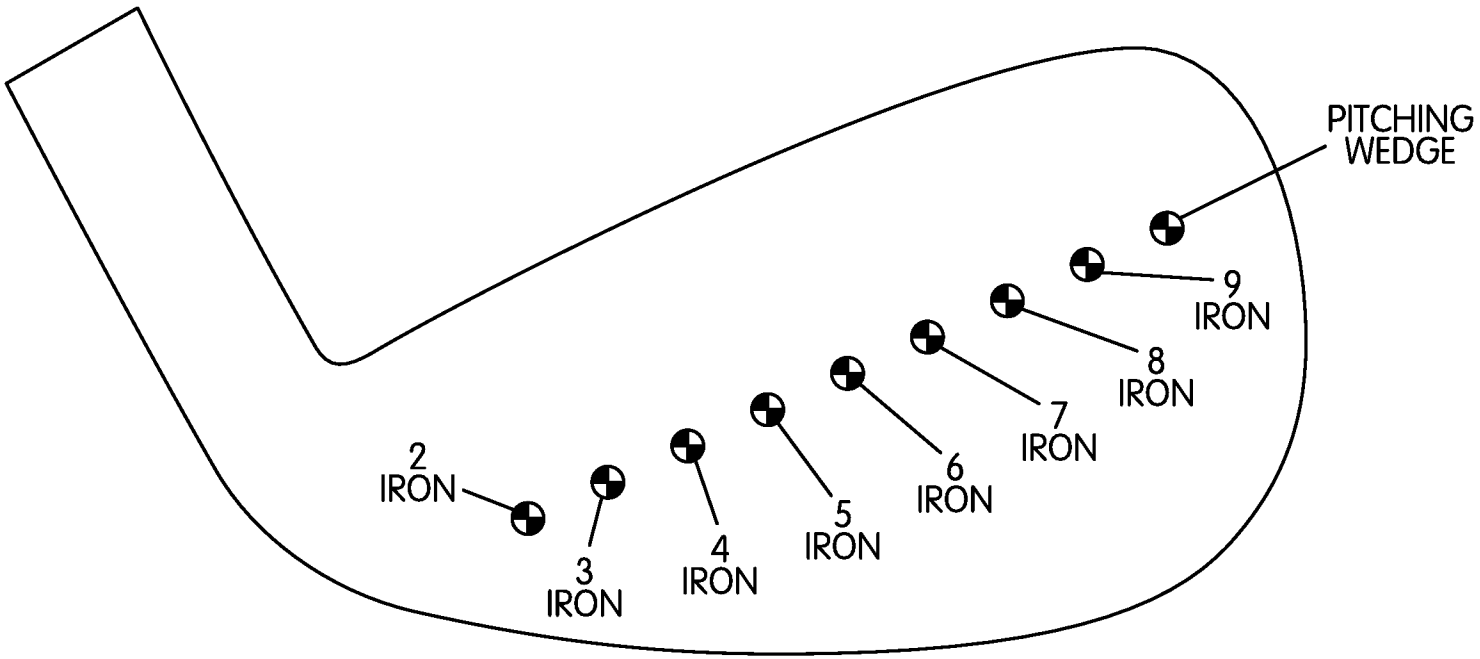
FIG. 2D schematically shows a progression of the centers of gravity of the club head bodies in a set of golf clubs according to examples of this disclosure.
Figure 2E:
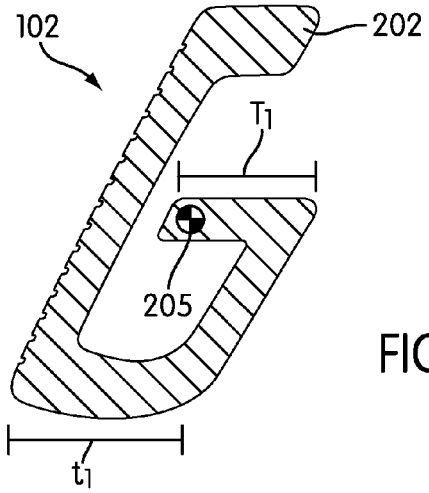
FIGS. 2E-2G illustrate cross sectional views of various golf club head structures according to at least some examples of this disclosure.

FIGS. 2A-L illustrate example features and structures that may be included in golf clubs and golf club head bodies in accordance with examples of this disclosure. As seen in FIGS. 2A-C, the golf club head body 102 may include a perimeter weighting member 202. As shown in FIG. 2E, the perimeter weighting member 202 may extend rearwardly from the ball striking face 102*a* and along at least a portion of a circumferential area of the golf club head body 102. Further, according to aspects of this disclosure, the golf club head body 102 may include a weight member 204 which is selectively shaped to redistribute the mass and weight of the golf club head body 102.

The weight member 204 may be either a portion of the perimeter weighting member 202 of the golf club head body 102 or a separate element(s) (e.g., made from the same or different materials as the perimeter weighting member 202) that is attached to the perimeter weighting member 202. The weight member 204 may be positioned at least along the top, bottom or side portions of the perimeter weighting member 202 and may form a portion of at least one of the top, bottom or side of the perimeter weighting member 202.

In the depicted embodiment, the weight member 204 extends from the sole portion of the club head body 102*d* into a cavity 206 in the rear portion of the club head body 102. Further, in the depicted embodiment, the weight member 204 is generally "T-shaped" and includes: a base portion 204*b* that extends from the club head body's sole 102*d*, an upper heel side portion 204*h*, and an upper toe side portion 204*t* which both extend from the base portion 204*b*. In the depicted embodiment the base portion 204*b* exhibits a "twist" such that "T-shaped" weight member 204 presents convex and concave surfaces which define slopes, different faces, etc. For example, as seen in the depicted embodiment, the point where the toe side of the base portion 204*b* meets the perimeter weighting member 202 is one end of a curvilinear line which extends from that point to the end of the upper heel side portion 204*h* of "T-shaped" weight member 204. As seen in the figures, this curvilinear line defines a break between different surfaces of the "T-shaped" weight member 204, and, at least in part, creates various sloped faces of the member 204.

According to some aspects of this disclosure, the shape of the weight member 204, can alter (e.g., shift) the center of the gravity of the club head body 102. For example, due to the weight member's weighting characteristics (weight, density, etc.), the shape of the weight member 204 will redistribute the weight of the golf club head body 102 (e.g., as compared to the golf club head body without the weight member 204) and thereby shift the club head body's center of gravity. Therefore, it is realized that the weight member 204 can be selectively shaped to control features of the club head body's center of gravity.

Hence, in a set of golf clubs according to some aspects of this disclosure, the weight member 204 for each golf club head body 102 may be differently shaped in order to provide a different location for the center of gravity of each particular golf club head body 102 in the set. FIGS. 2A-C illustrate example golf club head bodies 102 of such a set of golf clubs wherein each golf club head body 102 includes a differently shaped weight member 204 which creates a different mass and weight distribution and, therefore, provides a different center of gravity (which is denoted symbolically at reference numeral 205).

FIG. 2A is an illustrative embodiment of a golf club head body 102 for a "long" iron (e.g., a 3-iron). Specifically, in the arrangement shown in FIG. 2A, the weight member's "T-shape" is configured so that it is "slanted" or biased towards the heel end of the golf club head body 102. For example, as seen in the depicted embodiment, a upper heel side portion 204*h* of the "T-shaped" member 204 is near the heel end of the golf club head body 102 and, further, a majority of the "T-shaped" member 204 is in a heel side half of the cavity 206 (with respect to the center of the club head body 102). The particular shape of this weight member 204 distributes more mass and weight towards the heel end of the club head body 102. Thus, as can be seen in the figure, the center of gravity 205 is shifted so that it is closer to the heel of the club head body 102 (e.g., closer to the heel than the toe).

FIG. 2B is an illustrative embodiment of a golf club head body 102 for a "middle" iron (e.g., a 5-iron). In the arrangement shown in FIG. 2B, the weight member's "T-shape" is configured so that it is generally upright. For example, as seen in the depicted embodiment, both the upper heel side portion 204*h* and the upper toe side portion 204*t* of the "T-shaped" member 204 are relatively distant from the respective ends of the golf club head body 102 and, further, a majority of the "T-shaped" member 204 is generally in the center portion of the cavity 206. In other words, the weight member 202 is not "slanted" or biased towards either the heel or toe end of the golf club head body 102. The particular shape of this weight member 204 concentrates more mass and weight at the center of the club head body 102. Thus, as can be seen in the figure, the center of gravity 205 is relatively equidistant from the heel and toe end portions of the golf club head body 102.

FIG. 2C is an illustrative embodiment of a golf club head body 102 for a "short" iron (e.g., a 9-iron). In contrast to FIG. 2A, in the arrangement of FIG. 2C the weight member's "T-shape" is configured so that it is "slanted" or biased towards the toe end of the golf club head body 102. For example, as seen in the depicted embodiment, a upper toe side portion 204*t* of the "T-shaped" member 204 is near the toe end of the golf club head body 102 and, further, a majority of the "T-shaped" member 204 is in a toe side half of the cavity 206. The particular shape of this weight member 204 distributes more mass and weight at the toe end of the club head body 102. Thus, as can be seen in the figure, the center of gravity 205 is shifted so that it is closer to the toe of the club head body 102 (e.g., closer to the toe than the heel).

As will be appreciated by comparing FIGS. 2A, B and C, in addition to the "T-shaped" weight member's "slant" being varied from the heel to the toe of the golf club head body, others characteristics of different portions of the weight member 204 are also varied to achieve the desired mass and weight distribution. For example, the lengths of the upper heel side portion 204*h* and the upper toe side portion 204*t* are varied (e.g., as seen in FIG. 2A the length of the upper heel side portion 204*h* is greater than the length of the upper toe side portion 204*t*, while in FIG. 2C the length of the upper toe side portion 204*t* is greater than the length of the upper heel side portion 204*h*). Further, other characteristics of the "T-shaped" weight member portions could be varied. For example the upper heel side portion 204*h* and the upper toe side portion 204*t* may be widened or narrowed, made thicker or thinner, differently tapered (i.e., made relatively wide at one end and comparatively less wide at the other end, e.g., so they become wider or narrower as they extend from the base portion 204*b*), made symmetrical or asymmetrical (e.g., relative to the base portion 204*b*), etc. in order to achieve the desired center of gravity positioning. Alternatively, or additionally, the base portion 204*b* of the T-shaped weight member 204 could be made larger or smaller, made thicker or thinner, etc. thereby shifting the center of the gravity of the club head body 102.

Further, while according to some aspects of this disclosure, the weight member 204 may have the same weighting characteristics (weight, density, etc.) as the perimeter weighting member 202 (or at least some portions of the perimeter weighting member 202) or other portions of the club head body 102, according to other aspects of this disclosure, the weight member 204 may have a different weight, a different density, a different weight distribution, and/or other different weighting characteristics than the perimeter weighting member 202 (or at least some portions of the perimeter weighting member 202) or other portions of the club head body 102. For instance, the weight member 204 may be made heavier as compared to the other parts of the golf club head body 102 (e.g., by forming the weight member 204 from a different material than the other parts of the golf club head body 102 or by including a weighted mass, such as lead or tungsten containing material, etc. in the weight member 204).

Further, according to some aspects of this disclosure, different sections or portions of weight member 204 may have a different weight, a different density, a different weight distribution, and/or other different weighting characteristics than other sections or portions of the weight member 204. For example, in the depicted embodiment the upper portions 204*h* and 204*t* of the "T-shaped" weight member 204 may be made heavier as compared to the base portion 204*b* of the members (e.g., by forming the upper portions 204*h* and 204*t* of the member 204 from a different material than the base portion 204*b* or by including a weighted mass, such as lead or tungsten containing material, etc. in the upper portion of the member 204). Similarly, one of the upper toe side portion 204*t* or upper heel side portion 204*h* can be made heavier than the other.

Therefore, it is realized that there are various ways the weight members 204 (or portions thereof) could be differently shaped, oriented, weighted, etc. in order to create different mass and weight distributions which shift the center of gravity 205 of the golf club head body 102. Further, it is noted that, additionally different sections or portions of the perimeter weighting member 202 may also have a different weight, a different density, a different weight distribution, and/or other different weighting characteristics than other sections or portions of the perimeter weighting member 202 in order to create different mass and weight distributions which shift the center of gravity 205 of the golf club head body 102. For example, the crown portion of the perimeter weighting member 202 may be less dense the sole portion of the perimeter weighting member 202.

FIG. 2D schematically shows an entire progression of the position of the respective centers of gravity of the golf club head bodies 102 in a set of golf clubs according to such an embodiment of this disclosure. It is noted that the schematic rendering shown in FIG. 2D is not to scale and, instead, is used merely to give the reader a sense of the general progression of the center of gravity for one embodiment of this disclosure. As seen in FIG. 2D, the progression begins as a 2-iron (one of the club head bodies with a low degree of loft relative to the set of club head bodies) with the center of gravity 205 located generally towards the lower heel end of the club head body 102. The progression continues successively from the lower heel towards the upper toe of the club head body 102 until the progression ends as a pitching wedge (one of the club head bodies with a high degree of loft relative to the set of club head bodies) with the center of gravity 205 located generally towards the upper toe end of the club head body 102.

It is noted, of course, that FIG. 2D represents merely one embodiment of a set of golf clubs according to this disclosure and other sets of golf clubs according to this disclosure may include other clubs, such as sand wedges, lob wedges, hybrids irons, etc. It is further noted that other desired progressions (e.g., from the toe in "long" irons to the heel in "short" irons) or arrangements may be provided without departing from this disclosure. Therefore, it is realized that the weight members 204 may be shaped, positioned, arranged, etc. in the golf club head bodies 102 of a set of golf clubs in a variety of different manners, orientations, and the like without departing from this disclosure.

FIG. 2D demonstrates the effect that both the "slanting" and shaping of the "T-shaped" weight members 204 from the heel (e.g., as shown in FIG. 2A) towards the toe (e.g., as shown in FIG. 2C) have on the mass and weight distribution (and, hence, on the position of the center of gravity 205) for the golf club head bodies 102 in the set of golf clubs. The different locations of the center of gravity 205 of the club head bodies can affect the trajectory and ball flight of a golf ball struck by the golf club. Hence, it is understood that shaping weight members 204 in the golf club head bodies according to the embodiment shown in FIG. 2D can produce a set of golf clubs with desirable characteristics. For example, the configuration of FIG. 2A decreases the distance from the hosel to the center of gravity. Therefore, a "long" iron of such a set of golf clubs has a club head body with a center of gravity near the hosel. Hence, as discussed above, such "long" irons can aid a golfer in imparting a "draw" trajectory to the golf ball and, therefore, provide characteristics of a "draw" shot (i.e., less backspin, further roll and lower ball flight) which will tend to increase the distance that the golf ball will travel upon being struck by the golfer. Conversely, the configuration of FIG. 2C increases the distance from the hosel to the center of gravity 205. Therefore, a "short" iron of such a set of golf clubs has a club head body with a center of gravity 205 near the toe. Hence, as discussed above, such "short" irons can aid a golfer in imparting "fade" trajectory to the golf ball and, therefore, provide characteristics of a "fade" shot (i.e., more backspin, less roll and higher ball flight) which tend to provide enhanced ball control (e.g., stopping the ball on the green).

The weighting features of golf club head bodies in accordance with this disclosure are not limited to controlling the horizontal position of the golf club's center of gravity (the horizontal position when the golf club is oriented at a ball addressing position). Rather, the center of gravity in the vertical direction also may be selectively controlled, if desired, in at least some examples of golf club head structures according to this disclosure. Increasing the weight in the crown area of the club head (e.g., by providing more weight in the upper portion of the "T-shaped" weight member 204), produces a higher center of gravity in the golf club head which can provide a more boring golf ball flight path, e.g., for play in windy conditions, to provide more "running" shots, and/or to help compensate for swing flaws that typically produce an excessively high ballooning flight. Conversely, increasing the weight in the sole area of the club head (e.g., by providing more weight in the lower portion of the "T-shaped" weight member's base portion 204*b*), produces a lower center of gravity in the golf club head which can provide a more lofted golf ball flight path, which can help a golfer get the ball in the air.

Further, weighting features of golf club head bodies 102 in accordance with this disclosure are not limited to controlling the horizontal and vertical position of the golf club's center of gravity. Rather, according to some aspects of this disclosure, the depth position of the center of gravity (i.e., the position of the center of gravity in the direction from the face 102*a* to the rear of the golf club head body 102) can also be controlled. For example, the distance away from the face 102*a* that the weight member 204 is positioned will affect the center of gravity 205 in the depth direction. The closer the weight member 204 is positioned to the face 102*a* will result in the center of gravity 205 being shifted towards the face 102*a*, and conversely, the further that the weight member 204 is positioned away from the face 102*a*, the further the center of gravity 205 will be shifted away from the face 102*a*. Varying the position of the center of gravity 205 in the depth direction can be advantageous. For example, the Moment of Inertia (MOI) of the club head body 102 about its center of gravity is increased. Such an increased MOI can provide more "forgiveness" on "mis-hits" (i.e., shots wherein the golf ball is struck off center of the club head body 102), e.g., by reducing the amount the golf club head body will twist in response to the mis-hit. Another advantage of varying the position of the center of gravity 205 in the depth direction (e.g., by shaping or positioning the weight member 204 away from the face of the golf club head body 102 and, thereby, moving more mass and, hence, the center of gravity of the club head body 102 away from the face, is that such a configuration can create a higher ball flight.

According to some aspects of this disclosure, the weight member 204 may be positioned in the golf club head body 102 to provide a center of gravity of the golf club head body 102 which is relatively far from the club head face 102*a* (e.g., closer to the rear of the golf club head body than the face 102*a*). Because the center of gravity is closer to the rear of the golf club head, the golfer can more easily get the golf ball in the air. Therefore, golf clubs with such a golf club head body may be intended for a golfer who has trouble getting the ball in the air (e.g., a beginner). According to aspects of this disclosure, the center of gravity 205 may be positioned a distance of 0.125-2.0; 0.25-1.75; 0.5-1.5; 0.75-1.25; or 1.0-1.15 inches from golf club head body's face 102*a*.

In contrast, according to other aspects of this disclosure, the weight member 204 may be positioned in the golf club head body 102 to provide a center of gravity of the golf club head body 102 which is relatively close the club head face 102*a* (e.g., closer to the face 102*a* than the rear of the golf club head body 102). Because the center of gravity is closer to the face 102*a* of the golf club head, such a configuration will provide a trajectory for the flight of the golf ball which is lower than the above described configuration wherein the position of the center of gravity 205 is further away from the face 102*a*. Therefore, such a configuration can provide more distance in a golf shot. Therefore, golf clubs with such a golf club head body may be intended for a golfer who has little trouble getting the ball in the air (e.g., an experienced golfer) wherein distance, rather than assistance in getting the ball in the air, would be more valuable. According to aspects of this disclosure, in such a configuration the center of gravity 205 may be positioned a distance of 0.125-2.0; 0.25-1.75; 0.5-1.5; 0.75-1.25; or 1.0-1.15 inches from the golf club head body's face 102*a*.

Similarly to the above described embodiments, according to other aspects of this disclosure, the weight member 204 may be positioned in the golf club head body 102 to provide a center of gravity of the golf club head body 102 which is at a relatively intermediate distance from club head face 102*a*. Therefore golf clubs with such a golf club head body may be intended for a golfer who needs some help getting the ball in the air, but not as much as a beginner (e.g., an intermediate golfer). According to aspects of this disclosure, the center of gravity 205 may be positioned a distance of 0.125-2.0; 0.25-1.75; 0.5-1.5; 0.75-1.25; or 1.0-1.15 inches from the face of the golf club head body.

Figure 2F:
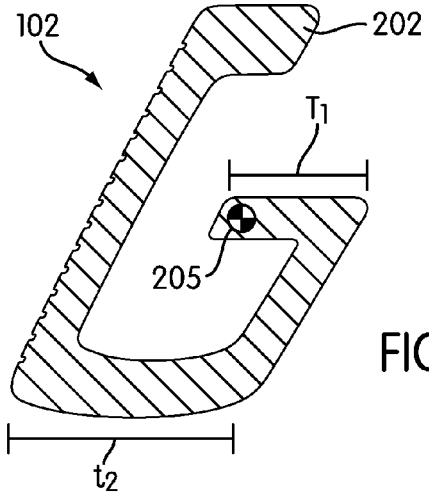

In order to provide the above variations in the position of the center of gravity 205 in the depth direction, the weight member 204 may extend from the heel, toe, sole, crown, etc. of the golf club head body 102 and be positioned separate and away from the rear surface of the face of the golf club head body 102 defined by the cavity 206. For example, FIG. 2E shows a cross-sectional view of an illustrative embodiment of the disclosure wherein the weight member 204 extends from the sole of the golf club head body 102 and positioned separate and away from the rear surface of the face of the golf club head body 102 defined by the cavity 206. Further, alternatively, or in addition to the weight member 204 extending from the perimeter weighting member 202, other methods may be employed to move the position of the center of gravity in the depth direction. For example, the portion of the golf club head body 102 from which the weight member 204 extends (e.g., the sole portion in FIG. 2E) could be made greater or smaller in the depth direction, thereby the controlling the positioning of the weight member 204 in the depth direction and, therefore, moving the center of gravity 205 closer to or further away from the golf club head body's face 102*a*. For example, as seen by comparing FIGS. 2E and 2F, the sole portion of the club head body 102 in FIG. 2F has a length of $t_2$ in the depth direction, while the sole portion in FIG. 2E has a length of $t_1$ in the depth direction, wherein $t_2$ is greater than $t_1$. Therefore, more mass of the golf club head body 102 shown in FIG. 2F is further away from the face of the club head body 102 than embodiment shown in FIG. 2E. Such a configuration would move the center of gravity 205 further from the golf club head body's face 102*a*. Hence, as can be seen, the center of gravity of the embodiment shown in FIG. 2F is further away from the face of the club body than the embodiment shown in FIG. 2E.

Figure 2G:
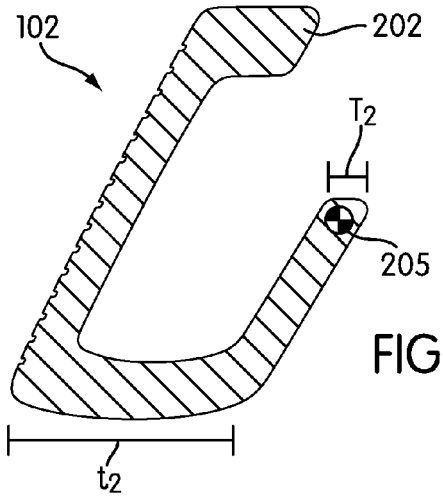

Other methods of moving the center of gravity in the depth direction could be employed additionally or as an alternative to the above described methods. For example, the weight member 204 itself could be shaped so that portions of it are closer to or farther away from the face 102*a*. For example, as seen in FIGS. 2E and 2F, the weight member 204 is shaped so that the upper portion of the "T-shape" is thicker in the depth direction than the base portion 204*b*. Therefore, the upper portion includes additional depth that extends inwards toward the face 102*a* when compared to the base portion 204*b*. This would move the center of gravity 205 closer to the golf club head body's face 102*a*. In comparison, as seen in FIG. 2G, the weight member 204 is not thicker in the depth direction and therefore does not extend inward toward the face. Hence, the center of the gravity 205 is further away from the golf club head body's face 102*a*. It is noted that according to some aspects of this disclosure the weight members 204 are selectively removable and interchangeable. Therefore, the weight members can be chosen based on their shape to provide a particular center of gravity which is a predetermined from the face of the golf club head. Further, because the weight members 204 are selectively removable and interchangeable, the position of the center of gravity in the depth direction may be varied by removing a particular weight member 204 and replacing it with a differently shaped weight member 204 (e.g., as a beginning player's skills develop, the weight members can be replaced as needed). It is noted, of course, that the weight members need not be selectively removable and interchangeable. Instead, the weight members could be formed with the club head or permanently attached to the club head bodies.

Other methods of moving the center of gravity in the depth direction could be employed additionally or as an alternative to the above described methods. For example, the weight member 204 could be angled from the perimeter weighting member 202 so that it extends towards or away from the rear surface of the club head body 102 defined by the cavity 206.

Any, some, or all of these methods for moving the position of the center of gravity in the depth direction could be employed in golf club head body 102 according to aspects of this disclosure. However, regardless of which particular methods are actually employed, it is realized that varying the position of the weight member 204 from the face of the golf club head body 102, affects the mass and weight distribution of the golf club head body 102 and, thereby, shifts the center of gravity 205 of the golf club head body 102 toward or away from the face of the golf club head body 102.

FIGS. 2E-G are cross-sectional views of golf club head bodies 102 which employ the above described methods of positioning the center of gravity 205 in the depth direction. For example, the embodiments shown in FIG. 2E-G have various sole portions with different lengths in the depth direction (i.e., different thicknesses), t, and, also, the embodiments shown in FIG. 2E-G have various weight members 204 with different lengths in the depth direction (i.e., different thicknesses), T (e.g., the upper portion of the "T-shape" includes additional depth that extends inwards toward the face 102*a*). The embodiment in FIG. 2E has thicknesses of T1 and t1, the embodiment in FIG. 2F has thicknesses of T1 and t2, and the embodiment in FIG. 2G has thicknesses of T2 and t2. As described above, the thickness of the portion of the golf club head body 102 from which the weight member 204 extends (e.g., the sole portion) and the thickness of weight member may control the positioning of the center of gravity in the depth direction.

For example, as can be seen by comparing FIGS. 2E, 2F and 2G, the different golf club head bodies 102 each have a different center of gravity 205. FIG. 2E is an illustrative embodiment of a golf club head body 102 wherein the center of gravity 205 is positioned relatively close to the face of the golf club head 102*a*. Such a club head body would be intended for more experienced golfers. FIG. 2F is an illustrative embodiment of a golf club head body 102 wherein the center of gravity 205 is positioned at a relatively intermediate distance from the face of the golf club head 102*a*. The center of gravity 205 is slightly further from the face 102*a* than the embodiment shown in FIG. 2E and, therefore, such a club head body 102 would be intended for intermediate golfers. FIG. 2G is an illustrative embodiment of a golf club head body 102 wherein the center of gravity 205 is positioned relatively far from the face of the golf club head. Therefore, the center of gravity 205 is further from the face 102*a* as compared with the embodiments shown in FIGS. 2E and 2F, hence, such a club head body 102 would be intended for beginning golfers.

Of course methods other than described above of controlling the position of the center of gravity in the depth direction could be employed in addition to varying the depth of the perimeter weighting member 202. For example, the upper portion of the "T-shape" could be angled towards or away from the face of the golf club head body which would move the center of gravity 205 closer to or further away from the golf club head body's face 102*a*.

While the above described embodiments (e.g., beginner clubs vs. clubs for an experienced golfer) may tend to suggest that all the clubs of a particular set have a relatively uniform distance between the face 102*a* and the golf club head body's center of gravity 205, it is noted that the distance between the face of the club head body 102*a* and, hence, the center of the gravity of the club head body 205 in the depth direction does not have to be uniform throughout the golf clubs in a set. For example, according to some embodiments of this disclosure, the distance between the face of the club head body 102*a* and the center of the gravity of the club head body 205 may vary based on the particular club rather than the set to which it belongs. Therefore, according to some aspects of this disclosure, the "short" irons of a set of golf clubs may have relatively "short" distance (as described above) between the face of the club head body 102*a* and the center of the gravity of the club head body 205, while the "long" irons have a relative great distance (as described above) the face of the club head body 102*a* and the center of the gravity of the club head body 205.

Figure 2H:
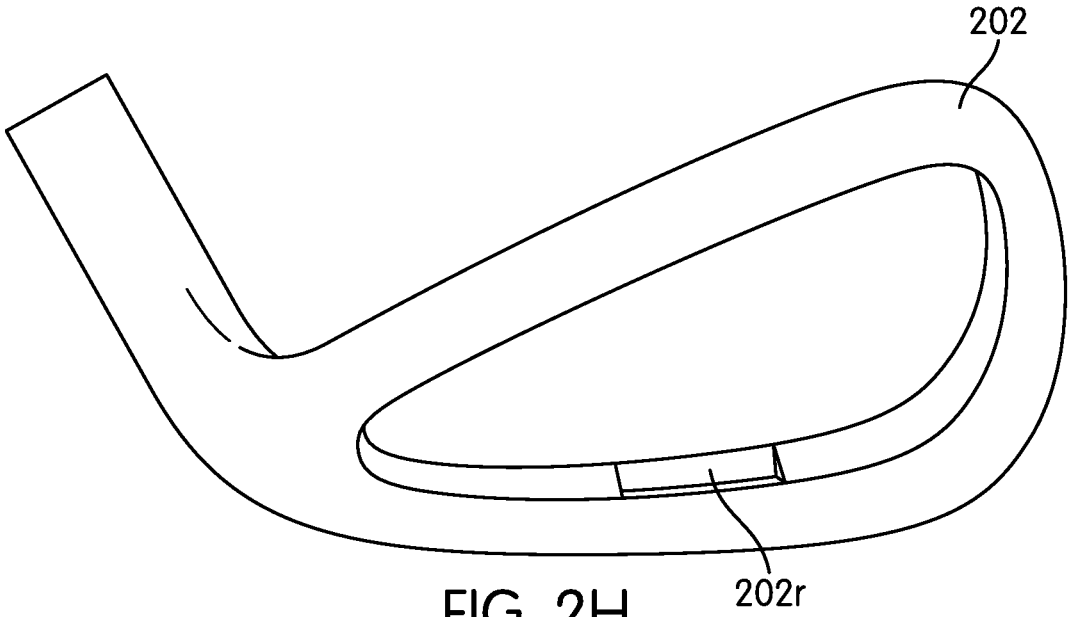
FIGS. 2H and 2I illustrate golf club head structures according to at least some examples of this disclosure.

As discussed above, according to some aspects of this disclosure the weight member 204 may be a separate element that is attached to the perimeter weighting member 202. FIG. 2H shows such an embodiment of the club head body 102. As seen in FIG. 2H the perimeter weighting member 202 includes a weight receiving portion (e.g., recess 202*r*) for receiving the weight member 204. The weight member 204 can be inserted into the recess 202*r* and secured via conventional means. For example, the weight member 204 could be secured to the club head body 102 in a variety of ways including: via adhesives, cements, welding, soldering, mechanical connectors (such as threads, retaining elements, snap fit, or the like), etc. If desired, the weight member 204 may be attached to the club head body 102 in a releasable manner using mechanical connectors to allow easy interchange of one weight member 204 for another. For example, the weight member 204 may be secured in place via a screw that passes through the sole of the club head body 102*d* from the bottom and into the base portion 204*h* of weight member 204.

Figure 2I:
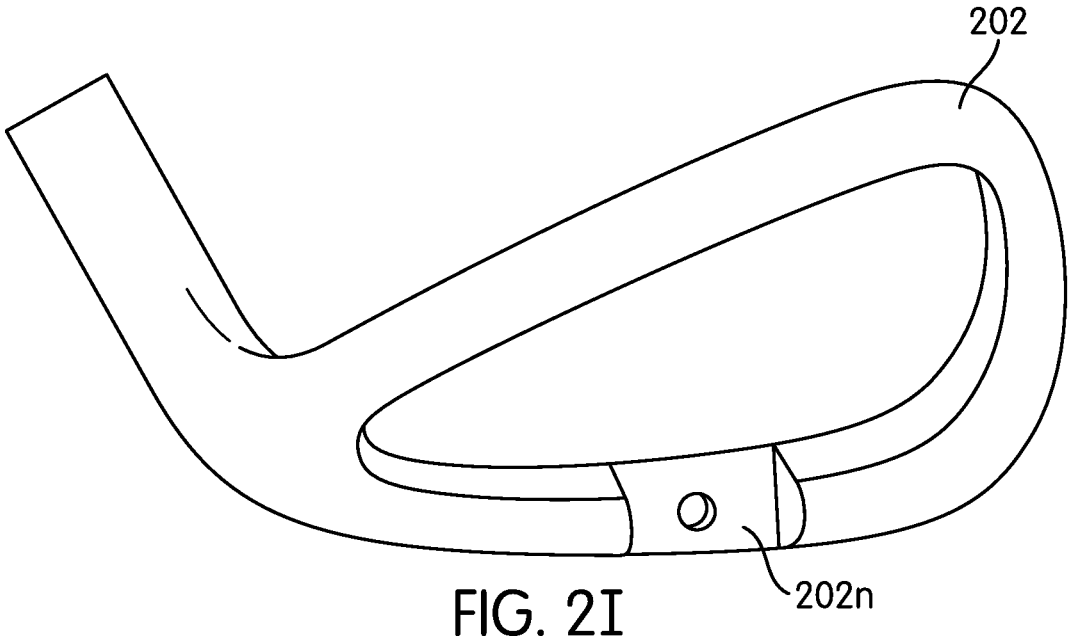
Figure 2J:
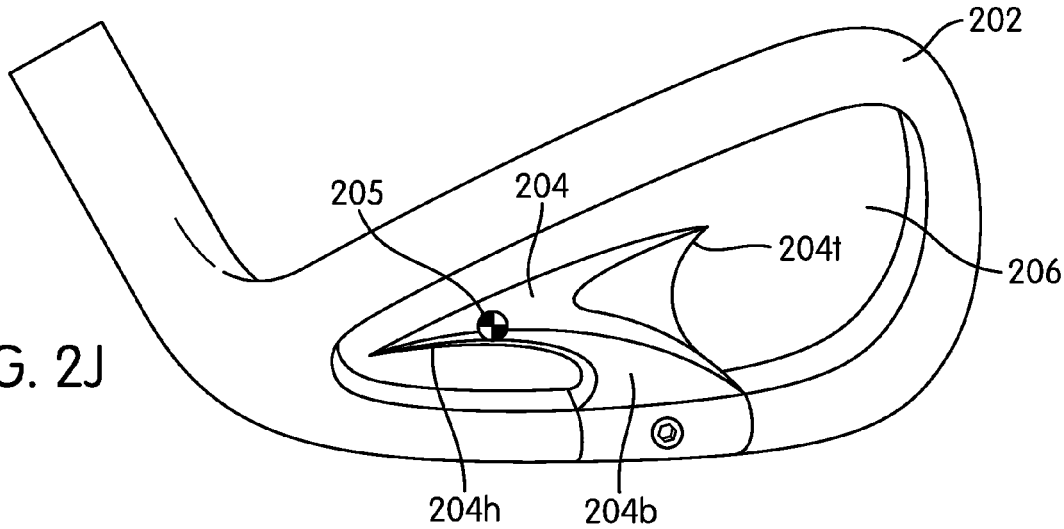
FIGS. 2J-2L illustrate a golf club head structure according to at least some examples of this disclosure.
Figure 2K:
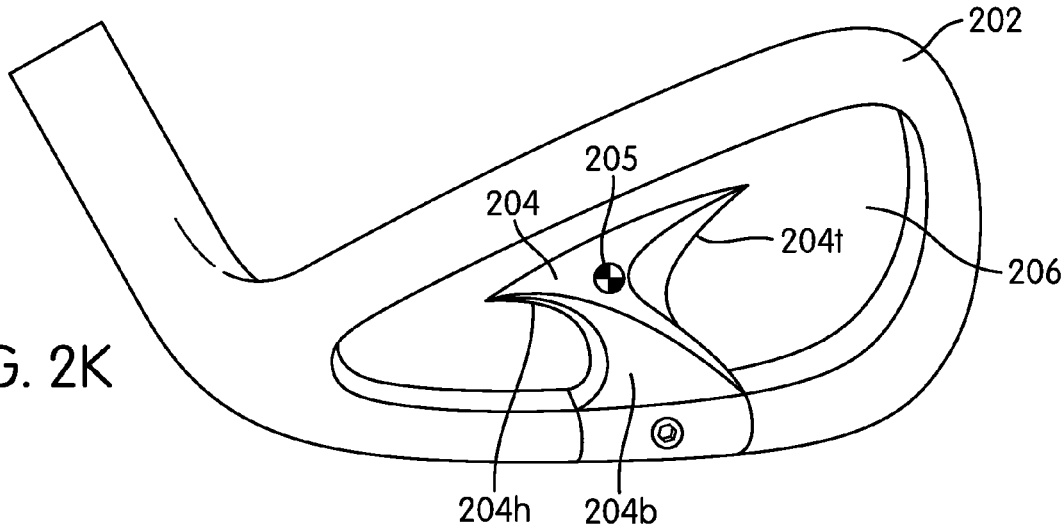
Figure 2L:
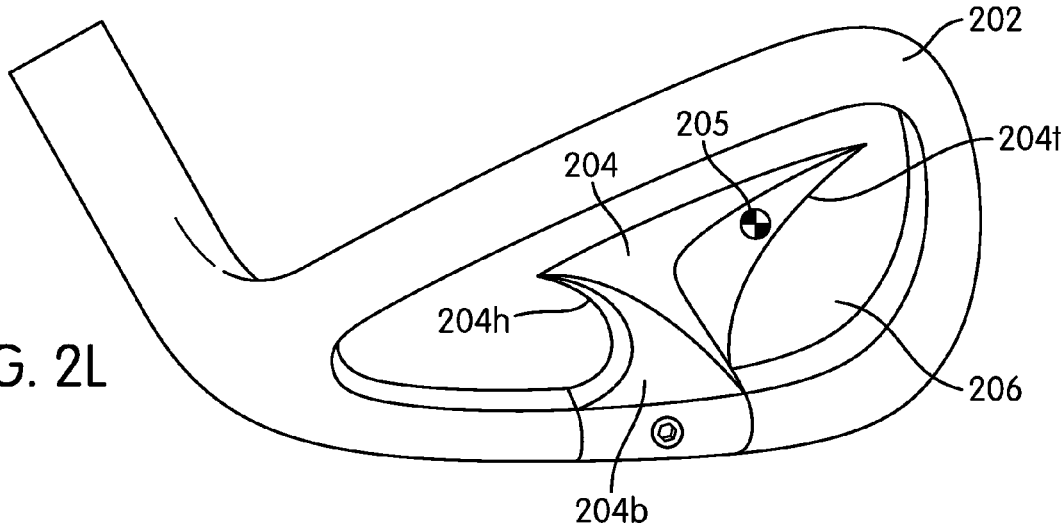

FIG. 2I shows an alternative embodiment of this disclosure wherein the members 204 are inserted into weight receiving portion in the form of a notch 202*n* that is a cutout of the perimeter weighting member 202. Similarly to the above described embodiment, the member 204 may be secured in place in a variety of ways including: via a screw that passes through the base portion of member 204 and into the club head body 102*d*. FIGS. 2J-L disclose example golf club head bodies 102 wherein such an embodiment is employed. Of course, other conventional methods, such as described above, could be used instead.

Such releasable methods of securing the weight member 204 would allow the member 204 to be removable and interchangeable with other differently shaped weight members 204 that could provide alternative mass and weight distributions. This would allow for different progressions or arrangements of the members 204 in the set of the golf clubs (e.g., opposite than the progression shown in FIG. 2D). In this way, the golf club head bodies 102 of the set could be customized to a particular golfer and varied over time as the golfer's abilities and tendencies change. For example, during a club fitting, the differently shaped weight members 204 could be attached to the club head bodies 102 in to better conform to a particular golfer's swing or tendencies. For example, during a club fitting, in order to analyze a particular golfer's swing, tendencies, characteristics, etc., a club fitter could use a variety of techniques including: observation with the naked eye of either the swing and/or the golfer's body throughout the swing; recording and play back (e.g., in slow motion or real time) of the swing and/or the golfer's body throughout the swing; measurement of particular aspects of the swing including: the angle of the club head and/or the shaft throughout the swing (e.g., at the take away, during the downswing, at impact, during the follow through, etc.), velocity or acceleration of the club head throughout the swing, etc.; image analysis (including images on a computer or television screen of real time action or play back recordings) of the swing, such as image analysis of the above mentioned characteristics; computer analysis of the swing, such as computer analysis of the above mentioned measurements and recordings; etc. Upon analyzing the particular golfer's swing or tendencies (e.g., in a manner described above), a club fitter could selectively exchange or replace the existing interchangeable weight members 204 in the club head bodies 102 with a different interchangeable weight member 204 based on the analysis of at least one characteristic of a golfer's swing in a manner to better aid a particular golfer achieve a desired result.

As seen in FIGS. 2H and 2I, the recess 202*r* and the notch 202*n* are in the sole portion of the perimeter weighting member 102*d*. However, they may be positioned may be positioned along the top, bottom or side portions of the perimeter weighting member 202 as desired. Regardless of the where the recess/notch is positioned in the perimeter weighting member 202, in such aspects of this disclosure, it provides a single common point wherein each of the weight members 204 are attached. Therefore, in such embodiments where the attachment point (i.e., the recess/notch) remains constant, and the shape of the weight member 204 changes to control the weight and mass distribution to selectively position the center of gravity, a "T-shaped" weight member 204 may be particularly effective (e.g., since one of the ends of the upper T-shaped portion could be extend or weighted more than the other end of the upper T-shaped portion). However, this is not to suggest that a T-shaped weight member must be used. Instead other embodiments of the weight member 204 could be employed. For example, an inverted triangular shaped weight member or an "H-shaped" weight member could be used. Additionally, the weight members 204 may be curved, arched, rounded, multi-leveled, stepped, etc. Hence, it is realized that the specific structure of the weight member 204 may vary without departing from this disclosure.

According to some aspects of this disclosure, the weight member 204 may generally indicate the golf club head body's center of gravity 205 and/or distinguish between different golf club head bodies 102. For example, as seen in FIG. 2A, the member's T-shape is "slanted" towards the heel end of the golf club head body 102. Therefore, the "slanted T-shape" weight member 204 generally indicates that that the golf club head body's center of gravity 205 is generally towards the heel section. Further, if the golf club is part of a set of golf clubs such as described in reference to FIG. 2D (i.e., wherein the "long" irons have weight members 204 directed towards the lower heel and the "short" irons have weight members 204 directed towards the toe) then the weight member 204 will indentify the golf club as a "long" iron and distinguish it from, for example, a "short" iron of the set. Similarly, the "T-shaped" weight member 204 of FIG. 2B which is generally upright (i.e., not "slanted" or biased towards either the heel or toe end of the golf club head body 102) indicates that the center of gravity 205 is generally located in the center of the club head body and the golf club is a "middle" iron, while the "T-shaped" weight member of FIG. 2C which is "slanted" towards the toe end of the golf club head body 102 indicates that the center of gravity 205 is generally located towards the toe section of the club head body and the golf club is a "short" iron.

In addition to the shape and orientation of the weight member 204 itself distinguishing the club, other different visual indicators, such as colors, could be used in conjunction with the weight member 204 to further indentify and distinguish golf clubs from each other. For example, different surfaces of the weight member 204 could be made different colors to distinguish between types of clubs (e.g., "short", "middle" or "long" irons) or between the individual clubs. For example, the surface of the weight member 204 that defines the upper portion of the T-shaped weight member 204 could be red for "short" irons, white for "middle" irons and black for "long" irons. Further, the rear surface of the face of the golf club head body 102 define by the cavity 206 could be made different colors to either contrast or correspond with the colored of the color surface of the weight member 204.

Further, it is noted that as an alternative to the weight member 204 being colored to distinguish from other clubs in the set, instead the rear surface of the face of the golf club head body defined by the cavity 206, by itself, could be colored to indentify and distinguish golf clubs from each other. For example, the rear surface of the face of the golf club head body defined by the cavity 206 could be red for "short" irons, white for "middle" irons and black for "long" irons. Overall, it is realized that as long as the visual indicator (e.g., the weight member 204 or rear surface of the golf club head body 102) indentifies and distinguishes golf clubs from each other, then it is considered within the scope of the disclosure. Therefore, it has been demonstrated that the weight member 204 and/or the rear surface of the golf club head body 102 defined by the cavity 206 can generally indicate the golf club head body's center of gravity 205 and distinguish the golf club from others in the set.

Therefore, it can be seen that according to aspects of this disclosure, the weight member 204 can be selectively shaped and/or selectively positioned to redistribute the mass and weight of the golf club head body 102 in order to shift the club head body's center of gravity 205 to a desired position (e.g., in the horizontal, vertical and/or depth direction), and also, if desired, generally indicate the location of the center of gravity of the golf club head body and/or distinguish the golf clubs from others in the set.

Figure 3A:
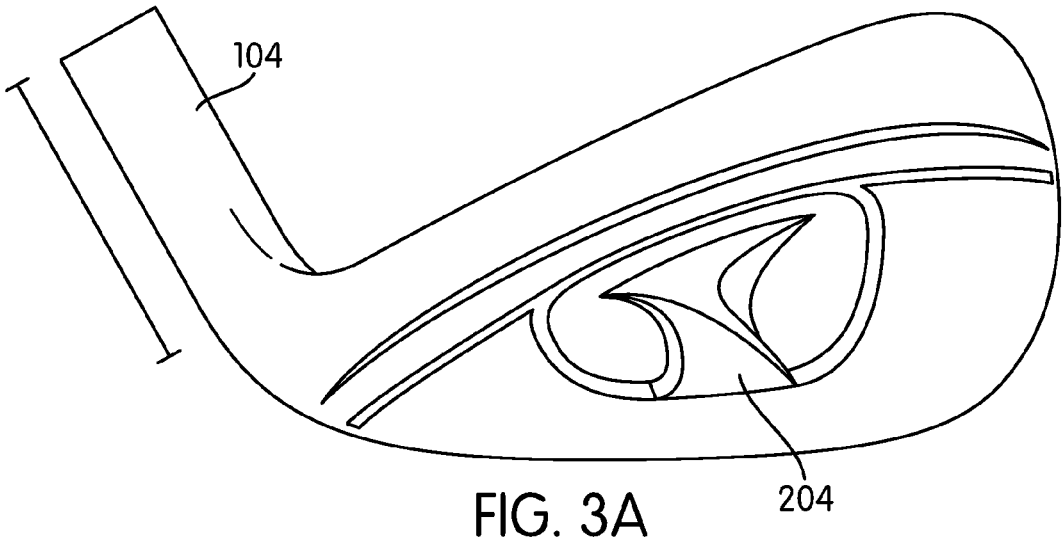
FIGS. 3A-3B illustrate golf club head structures according to at least some examples of this disclosure.
Figure 3B:
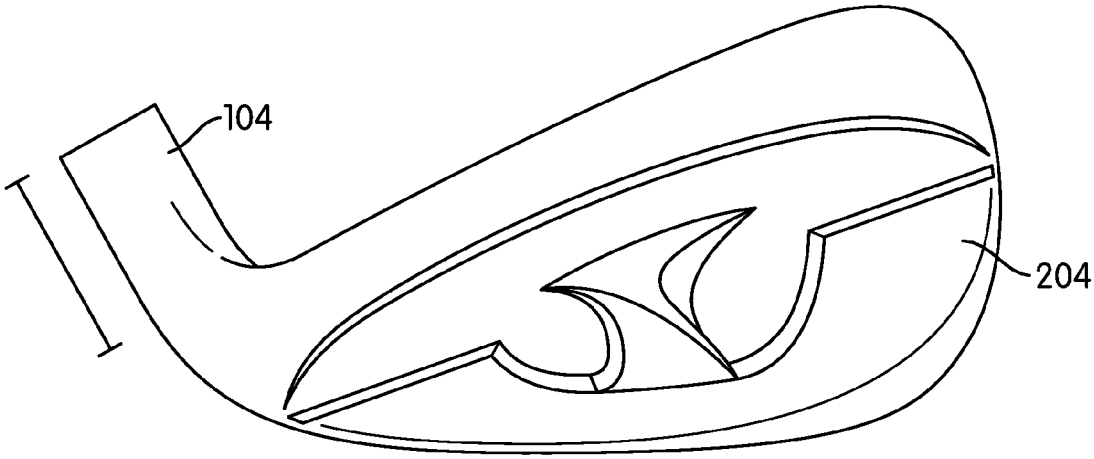

FIGS. 3A and 3B illustrate alternative embodiments of golf club head bodies according to aspects of the disclosure. As seen in these embodiments, both the weight member 204 and the hosel 104 can be manipulated to control the mass of the golf club head body 102 and thereby, control (e.g., selectively position) the center of gravity of the club head body 102. For example, as seen by comparing FIGS. 3A and 3B, the embodiment shown in FIG. 3B has a shorter hosel 104 than the hosel of the embodiment shown in FIG. 3A. Therefore, the mass of the hosel 104 of the embodiment shown in 3B is smaller than that of the embodiment shown in FIG. 3A. Hence, the overall mass of the club head body 102 of the embodiment shown in FIG. 3B is vertically lower than that of the embodiment shown in FIG. 3A. Resultantly, the center of gravity of the club head body 102 of the embodiment shown in FIG. 3B is vertically lower than that of the embodiment shown in FIG. 3A. According to example aspects of this disclosure, a hosel may have a length of 0.5-5.0; 1.0-4.0; 2.0-3.0; or 2.25-2.75 inches.

Further, the weight member 204 may be configured so that the mass is moved vertically. For example, as seen by comparing FIGS. 3A and 3B, the embodiment shown in FIG. 3B has a weight member 204 with a configuration that provides more mass at a lower position than that of the weight member 204 of the embodiment shown in FIG. 3A. Hence, the overall mass of the club head body 102 of the embodiment shown in FIG. 3B is vertically lower than that of the embodiment shown in FIG. 3A. Resultingly, the center of gravity of the club head body 102 of the embodiment shown in FIG. 3B is vertically lower than that of the embodiment shown in FIG.

3A. As discussed above, moving more mass lower in the club head body (e.g., by manipulating the size of the hosel 104 and/or the configuration of the weight member 204) produces a lower center of gravity in the golf club head which can provide a more lofted golf ball flight path, which can help a golfer get the ball in the air. Such features may particular advantageous in long iron-type golf clubs. For example, according to aspects of this disclosure, long irons will include shorter hosels and lower weight members than other irons in a golf club set.

Figure 4A:
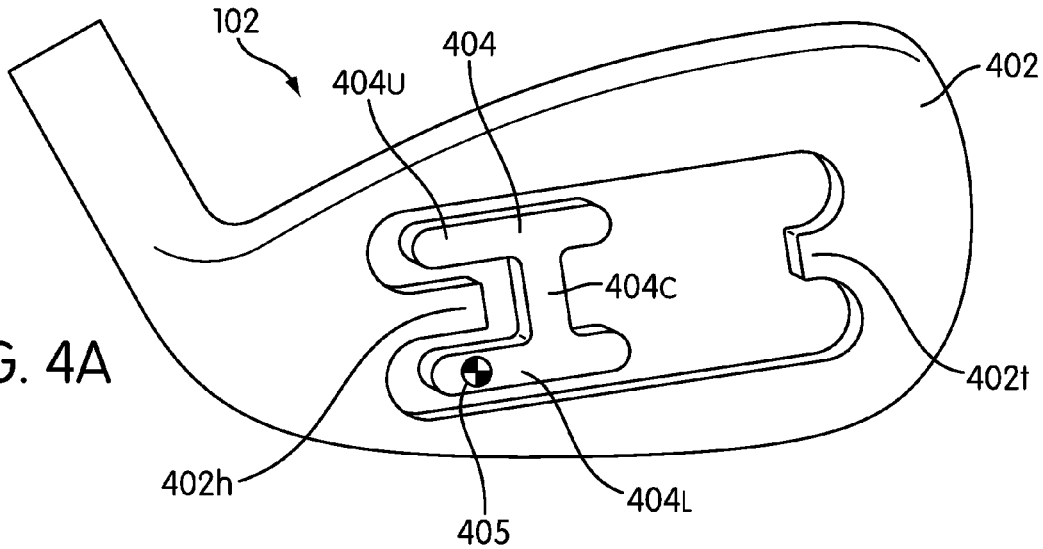
FIGS. 4A-4C illustrate a golf club head structure according to at least some examples of this disclosure.
Figure 4B:
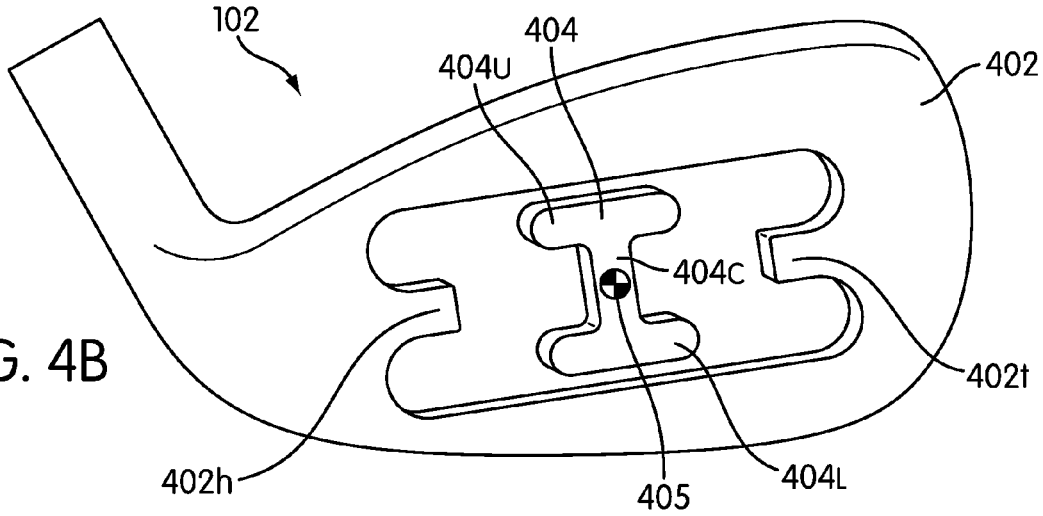
Figure 4C:
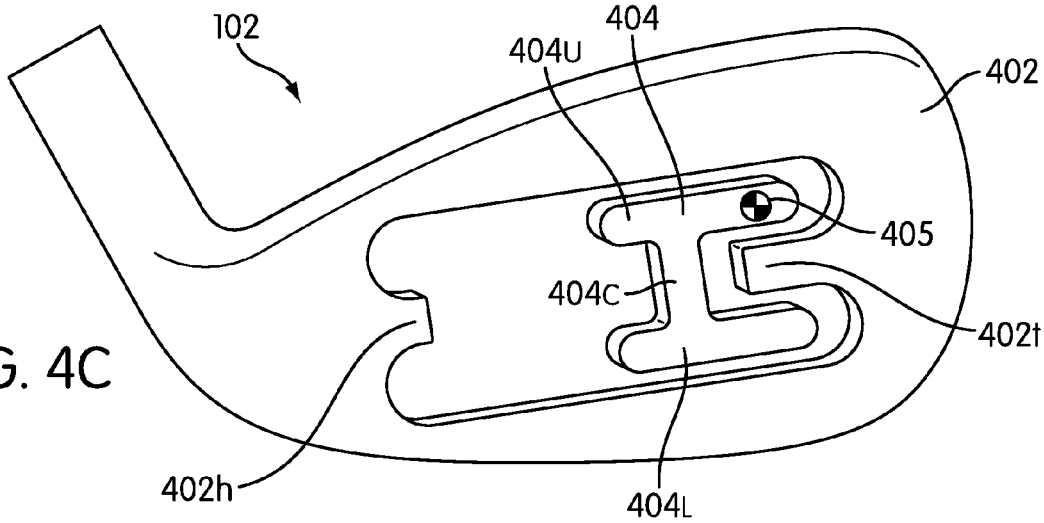

FIGS. 4A-C illustrate an alternative embodiment of a golf club head body according to aspects of the disclosure. The embodiment shown in FIGS. 4A-C is similar to the embodiments described above and, therefore, for the sake of brevity will not be elaborated on in detail here. However, it is noted that in this embodiment, the golf club head body may include a weight member which can be selectively shaped and/or positioned to redistribute the mass and weight of the golf club head body. Further, according to aspects of this disclosure, the golf club head body may include a perimeter weighting member which can be selectively shaped to redistribute the mass and weight of the golf club head body.

For example, according to some aspects of this disclosure, and as discussed in detail with regard to the embodiments described above, due to the weight member's weighting characteristics (weight, density, etc.), the shape of the weight member will redistribute the weight of the golf club head body and thereby shift the club head body's center of gravity. Further, the weighting member's positioning relative to the golf club head body will redistribute the weight of the golf club head body and thereby shift the club head body's center of gravity. Therefore, the weight member maybe be selectively shaped and/or selectively positioned relative to the golf club head body to control features of the club head body's center of gravity. Further, according to some aspects of this disclosure, due to the perimeter weighting member's weighting characteristics (weight, density, etc.), the shape of the perimeter weighting member will redistribute the weight of the golf club head body and thereby shift the club head body's center of gravity. Therefore, in addition to the weight member being selectively shaped and/or selectively positioned, the perimeter weighting member can also be selectively shaped to control features of the club head body's center of gravity.

As can be seen in FIGS. 4A-4C, a perimeter weighting member 402 may extend rearwardly from the ball striking face 102*a* and along at least a portion of a circumferential area of the golf club head body 102. Further, according to aspects of this disclosure, a weight member 404 may be included in a rear portion of the golf club head body 102. As seen in the depicted embodiment, a weight member 404 is neither a portion of the perimeter weighting member 402 of the golf club head body 102 nor attached to the perimeter weighting member 402.

The weight member 404 may be either formed with the golf club head body 102 or attached to the golf club head body. For example, during manufacture of the golf club head bodies 102, the golf club head bodies including the weight member 404 could be formed together (e.g., in a mold). Alternatively, the weight member 404 could be attached to the club head body 102 in a variety of ways including: via adhesives, cements, welding, soldering, mechanical connectors (such as threads, retaining elements, snap fit, or the like), etc. If desired, the weight member 404 may be attached to the club head body 102 in a releasable manner using mechanical connectors to allow easy interchange of multi-legged bridge member 404 for another. For example, the weight member 404 may be secured in place via a screw that passes through the club head body 102*a* (e.g., from the face 102*a* and into a portion of the weight member 404). In order to place the weight member 404 in different positions relative to the club head body (as will be discussed in more detail below), the club head body 102 may include a series of receiving means (e.g., holes, notches, etc.) throughout the club head body 102.

As seen in the depicted embodiment, the weight member 404 is positioned within a cavity 406 without contacting the top, bottom or side portions of the perimeter weighting member 402. In the depicted embodiment, the member 204 is generally "H-shaped" and is "rotated" 90° so that the "H-shape" is "sideways." In other words, the weight member 404 has a thinner center portion 404*c* which extends in the sole to crown direction and which connects the weight member's upper portion 404*u* and lower portion 404*l*. Further, as seen in the depicted embodiment the upper portion 404*u* and lower portion 404*l* extend in the heel to toe direction and have a heel portion that extends from the center portion 404*c* towards the heel and a toe portion which extends from the center portion 404*c* towards the toe. An "H-shaped" weight member 404 may be particularly effective in redistributing mass and weight because one or both of the upper or lower portion's heel or toe ends could be extended or weighted more than the other portion or end of the "H-shaped" member. For example, the weight member 404 can be shaped to concentrate more of the mass and the weight of the club head body at the heel (e.g., see FIG. 4A wherein the weight member 404 has been shaped to so that the heel side of the upper and lower portions 404*h* and 404*l* are exaggerated in order to shift more of the mass and the weight of the club head body towards the heel of the club head body 102). Conversely, the weight member 404 can be shaped to concentrate more of the mass and the weight of the club head body at the toe (e.g., see FIG. 4C wherein the weight member 404 has been shaped to so that the toe side of the upper and lower portions 404*h* and 404*l* are exaggerated in order to shift more of the mass and the weight of the club head body towards the heel of the club head body 102). However, it is noted that the depicted embodiment is not intended to suggest that an "H-shaped" weight member 404 must be used. Instead other embodiments of the weight member 404 could be employed. Hence, it is realized that the specific structure of the member 404 may vary without departing from this disclosure.

Further, alternatively, or in addition to the weight member 404 being selectively shaped, the weight member 404 can be selectively positioned relative to the golf club head body 102 to redistribute the mass and weight of the golf club head body 102. For example, the weight member 404 can be positioned closer to the heel to concentrate more of the mass and the weight of the club head body at the heel of the club head body (e.g., see FIG. 4A wherein the weight member 404 has been shifted within the cavity 406 towards the heel of the club head body 102). Conversely, the weight member 404 can be positioned closer to the toe to concentrate more of the mass and the weight of the club head body at the toe of the club head body (e.g., see FIG. 4C wherein the weight member 404 has been shifted within the cavity 406 towards the toe of the club head body 102).

Further, alternatively, or in addition to the weight member 404 being selectively shaped and/or positioned, the perimeter weighting member 402 may be selectively shaped to redistribute the mass and weight of the golf club head body 102. For example, in the depicted embodiment, the perimeter weighting member 402 is shaped with protrusions that extend towards the interior of the cavity 406. Similarly to the weight members 404, the protrusions provide additional mass and weight at specific portions of the club head body 102 in order to redistribute the mass and weight of the golf club head body 102 and to alter (i.e., shift the center of gravity of the club head body 102). According to some aspects of this disclosure, the protrusions can correspond to the shape of the weight member. For example, as seen in FIGS. 4A-4C, the depicted embodiment includes two protrusions: a protrusion 402*h* at the heel side of the perimeter weighting member and a protrusion 402*t* at the toe side of the perimeter weighting member. The two protrusions 402*h* and 402*t* correspond to or complement the shape of the "H-shape" of weight member 402. For example, the protrusion 402*h* extends towards the recess in the heel side of the weight member 404 which is defined by the heel side of the upper and lower portions 404*h* and 404*l* of the weight member 404. Similarly, protrusion 402*t* extends towards the recess in the toe side of the weight member 404 which is defined by the toe side of the upper and lower portions 404*h* and 404*l* of the weight member 404. As seen, in some embodiments the protrusions may actually extend into the recesses of the weight member 404. Therefore, despite not contacting each other, both the perimeter weighting member 402 and the weight member 404 may be selectively shaped to redistribute the mass and weight of the golf club head body 102.

Based on the above features, it is realized that there are various ways in which the weight members 404 and/or the perimeter weighting members 402, may be differently shaped, oriented, positioned, etc. in order to create different mass and weight distributions which shift the center of gravity of the golf club head body 102.

Hence, in a set of golf clubs according to some aspects of this disclosure, the weight member 404 and/or the perimeter weighting member 402 for each golf club head body 102 may be differently shaped and/or the weight member 404 may be differently positioned relative to the club head body 102 in order to provide a different location for the center of gravity of each particular golf club head body 102 in the set. FIGS. 4A-C illustrate example golf club head bodies 102 of a set of golf clubs wherein each golf club head body 102 includes a differently shaped and positioned weight member 404 and a differently shaped perimeter weighting member which create a different mass and weight distribution and, therefore, provides a different center of gravity (which is denoted symbolically at reference numeral 405).

FIG. 4A is an illustrative embodiment of a golf club head body 102 for a "long" iron (e.g., a 3-iron), FIG. 4B is an illustrative embodiment of a golf club head body 102 for a "middle" iron (e.g., a 5-iron), and FIG. 4C is an illustrative embodiment of a golf club head body 102 for a "short" iron (e.g., a 9-iron). As seen, the shape of the weight member 404 is different in each of the golf club head bodies 102 that are shown in FIGS. 4A-C in order to provide the different centers of gravity.

In FIG. 4A, the weight member's "H-shape" is configured so that the heel sides of its upper and lower portions 404*u* and 404*h* are exaggerated (i.e., made larger) and the toe sides of its upper and lower portions 404*u* and 404*h* are reduced. Further, the perimeter weighting member's heel side protrusion 402*h* is exaggerated (i.e., made larger). In this way, as shown, the perimeter weighting member's exaggerated heel side protrusion 402*h* extends between the exaggerated portions on the upper and lower portions 404*u* and 404*l* of the H-shaped weight member's heel side. Additionally, the "H-shaped" weight member 404 is positioned closer to the heel (e.g., closer to the heel than the toe). Therefore, the weight member 404 and the perimeter weight member 402 are shaped and the weight member 4040 is positioned so resulting configuration concentrates mass and weight towards the heel of the golf club head body 102. Thus, as can be seen in the figure, the center of gravity 405 is shifted so that it is closer to the heel of the club head body (e.g., closer to the heel than the toe). FIGS. 4B and 4C are describe similar embodiments wherein the weight member 404 and perimeter weighting member 402 are shaped and the weight member 404 is positioned relative to the club head body in order to concentrate mass and weight around the center or toe portion of the golf club head body 102, respectively. Because the description of these embodiments would be so similar to the above described embodiments for the sake of brevity they will not be further elaborated on here.

FIGS. 4A-4C demonstrate the effect that shaping of the "H-shaped" weight members 404 and the perimeter weighting member 402 and the placement of the "H-shaped" weight member relative to the club head body 102 has on the mass and weight distribution (and, hence, on the position of the center of gravity 405) for the golf club head bodies 102 in the set of golf clubs.

Further, the embodiments shown in FIGS. 4A-C, are golf club head bodies 102 of a set of golf clubs with different centers of gravity wherein the centers of gravity follow a progression similar to the schematically shown progression of FIG. 2D, wherein the progression begins as a 2-iron (one of the club head bodies with a low degree of loft relative to the set of club head bodies) with the center of gravity 405 located generally towards the lower heel end of the club head body 102 and continues from the lower heel towards the upper toe of the club head body 102 until the progression ends as a pitching wedge (one of the club head bodies with a high degree of loft relative to the set of club head bodies) with the center of gravity 405 located generally towards the upper toe end of the club head body 102.

It is noted, of course, that FIG. 4A-C are examples of a set that represents merely one embodiment of a set of golf clubs according to this disclosure and other sets of golf clubs according to this disclosure may include other clubs, such as sand wedges, lob wedges, hybrids irons, etc. It is further noted that other desired progressions (e.g., from the toe in "long" irons to the heel in "short" irons) or arrangements may be provided without departing from this disclosure. Therefore, it is realized that the weight members 404 and the perimeter weighting members 402 may be shaped, positioned, arranged, etc. in the golf club head bodies 102 of a set of golf clubs in a variety of different manners, orientations, and the like without departing from this disclosure. For example, such as in the manners described in the club fitting example described above.

As discussed above, the different locations of the center of gravity of the club head bodies can affect the trajectory and ball flight of a golf ball struck by the golf club. Hence, it is understood that shaping and positioning the weight members 404 in the progression that the golf club head bodies 102 shown in FIG. 4A-C represent will therefore produce a set of golf clubs with desirable characteristics. For example, the configuration of FIG. 4A decreases the distance from the hosel to the center of gravity. Therefore, a "long" iron of such a set of golf clubs has a club head body with a center of gravity near the hosel. Hence, as discussed above, such "long" irons can aid a golfer in imparting a "draw" trajectory to the golf ball and, therefore, provide characteristics of a "draw" shot (i.e., less backspin, further roll and lower ball flight) which will tend to increase the distance that the golf ball will travel upon being struck by the golfer. Conversely, the configuration of FIG. 4C increases the distance from the hosel to the center of gravity 405. Therefore, a "short" iron of such a set of golf clubs has a club head body with a center of gravity 405 near the toe. Hence, as discussed above, such "short" irons can aid a golfer in imparting "fade" trajectory to the golf ball and, therefore, provide characteristics of a "fade" shot (i.e., more backspin, less roll and higher ball flight) which tend to provide enhanced ball control (e.g., stopping the ball on the green).

It is noted, that the weighting features of golf club head bodies in accordance with this embodiment of the disclosure are not limited to controlling the horizontal position of the golf club's center of gravity (the horizontal position when the golf club is oriented at a ball addressing position). Instead, as discussed above in regard to the previously described embodiments, aspects of this disclosure relate to configuring the golf club head so that the center of the center of gravity of the club head body 102 is moved in a vertical direction (e.g., by the upper or lower portion of the "H-shaped" member 404 being made heavier to lighter, or the perimeter weight member 402 having protrusions and the crown or sole portions 102*c*, 102*d* of the club head body 102 or the "H-shaped" weight member 404 being positioned higher are lower in the cavity, etc.) or depth direction (e.g., by having a tapered portion of the "H-shaped" weight member 404 near the club head body's face 102*a* which becomes a heavier, thicker portion as the H-shaped member 402 extends away from the club head body's face 102*a*). Since such features are described in detail above, for the sake of brevity they will not be further elaborated here.

Further, as discussed above in regard to the previously described embodiments, according to some aspects of this disclosure, the weight member 404 (or portions thereof) may have the same or different weighting characteristics (weight, density, etc.) as the perimeter weighting member 402 (or at least some portions of the perimeter weighting member 402) or other portions of the club head body 102. For example, in the depicted embodiment the upper portion 404*u* of the "H-shaped" weight member 404 may be made heavier as compared to the lower portion 404*l* of the members (e.g., by forming the upper portion 404*u* from a different material than the lower portion 204*l* or by including a weighted mass, such as lead or tungsten containing material, etc. in the upper portion 404*u*). Similarly, one of the upper or lower portion's toe or heel sides can be made heavier than the other. Further, it is noted that, different sections or portions of the perimeter weighting member 402 may also have a different weight, a different density, a different weight distribution, and/or other different weighting characteristics than other sections or portions of the perimeter weighting member 402. Additionally, since such weighting features are described in detail above, for the sake of brevity they will not be further elaborated on here.

Further, similarly to the previously described embodiments, according to some aspects of this disclosure, the shaping of the weight member 404 and the perimeter weighting member and the positioning of the weight member 404 relative to the golf club head body 102 may generally indicate the golf club head body's center of gravity 405 and/or distinguish between different golf club head bodies 102. Further, as discussed in detail above with regard to the previously described embodiments, in addition to the shape positioning and orientation of the weight member 404 and/or the perimeter weighting member 402 distinguishing the club, other different visual indicators, such as colors, could be used in conjunction with the weight member 404 and/or the perimeter weighting member 402 to further indentify and distinguish golf clubs from each other (e.g., in manners as described in relation to the above embodiments).

Therefore, it can be seen that according to aspects of this disclosure, the weight member 404 can be selectively shaped and/or selectively positioned and the perimeter weighting member 402 can be selectively shaped to redistribute the mass and weight of the golf club head body 102 in order to shift the club head body's center of gravity 405 to a desired position (e.g., in the horizontal, vertical and/or depth direction), and also, if desired, generally indicate the location of the center of gravity of the golf club head body and/or distinguish the golf clubs from other in the set.

Figure 4D:
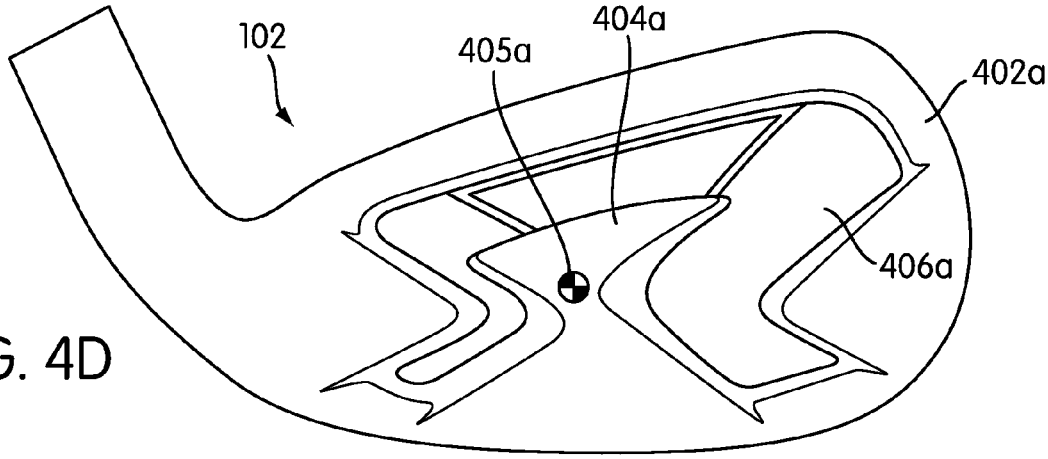
FIGS. 4D-4F illustrate a golf club head structure according to at least some examples of this disclosure.
Figure 4E:
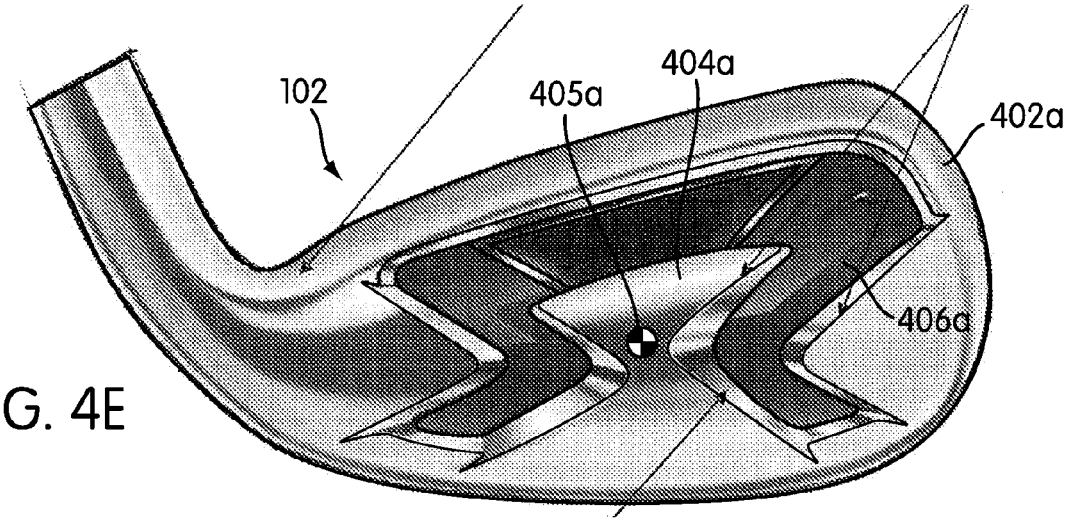
Figure 4F:
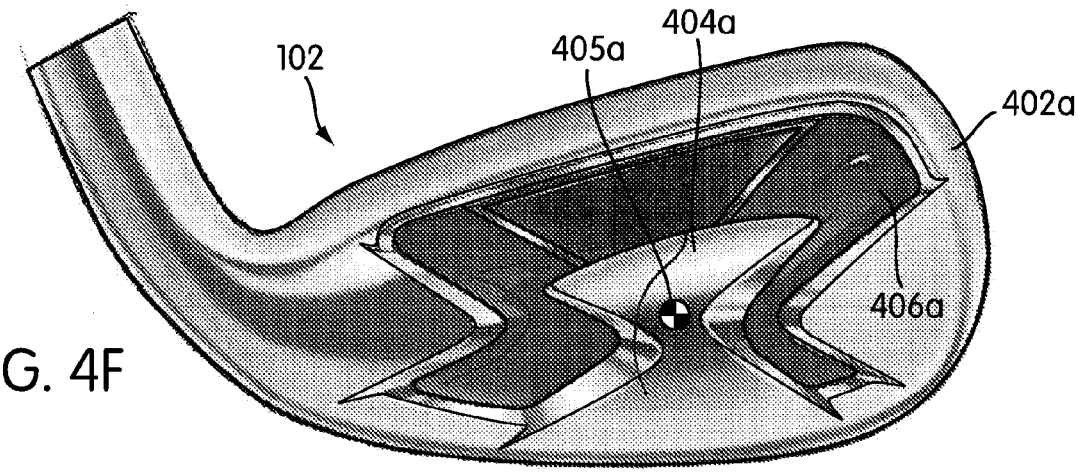

As mentioned above, the weight member and the perimeter weighting member may take on a wide variety of forms without departing from the spirit of disclosure. For example, according to some aspects of this disclosure, the weight member and the perimeter weighting member may include some of the aspects of each of the embodiments described above. For example, FIGS. 4D-F illustrate such an alternative embodiment of a golf club head body according to aspects of the disclosure. The embodiment shown in FIGS. 4D-F is similar to the embodiment described above in regard to FIGS. 2A-L in that it has a T-shape weight member 404*a*. For the sake of brevity characteristics of the T-shape weight member 404*a* will not be elaborated on in detail here. Further, it is noted that this embodiment shown in FIGS. 4D-F is similar to the embodiment described above in regard to FIGS. 4A-C in that the weight member 404*a* can be selectively positioned to redistribute the mass and weight of the golf club head body 102. Further, according to aspects of this disclosure, the golf club head body 102 may include a perimeter weighting member 402*a* with protrusions that correspond to the shape of the weight member 404*a*.

FIGS. 4D-F illustrate example golf club head bodies 102 of a set of golf clubs wherein each golf club head body 102 includes a differently positioned weight member 404*a* and which creates a different mass and weight distribution and, therefore, provides a different center of gravity (which is denoted symbolically at reference numeral 405).

FIG. 4D is an illustrative embodiment of a golf club head body 102 for a "long" iron (e.g., a 3-iron), FIG. 4E is an illustrative embodiment of a golf club head body 102 for a "middle" iron (e.g., a 5-iron), and FIG. 4F is an illustrative embodiment of a golf club head body 102 for a "short" iron (e.g., a 9-iron). As seen, the position of the weight member 404*a* is different in each of the golf club head bodies 102 that are shown in FIGS. 4D-F in order to provide the different centers of gravity 405*a*. For the sake of brevity, since the positioning of the T-shape (e.g., vertically, heel to toe, etc.) is described above in great detail, it will not be elaborated on here.

As mentioned above, the weight member may take on a wide variety of forms without departing from the spirit of disclosure. According to some aspects of this disclosure, the weight member may comprise one or more portions which together make up the member. For example, a first portion may be a bridge member which extends between two ends of the golf club head body and a second portion may be a mass member that provides additional mass and weight at particular positions.

FIGS. 5A-D illustrate an alternative embodiment of a golf club head body according to aspects of the disclosure. The embodiment shown in FIGS. 5A-D is similar to the embodiments described above and, therefore, for the sake of brevity will not be elaborated on in detail here. However, it is noted that in this embodiment, the golf club head body may include a weight member which can be selectively shaped and/or positioned to redistribute the mass and weight of the golf club head body. Further, according to aspects of this disclosure, the weight member may include a bridge member which extends between two ends of the golf club head body and a mass member that provides additional mass and weight at particular positions.

Figure 5A:
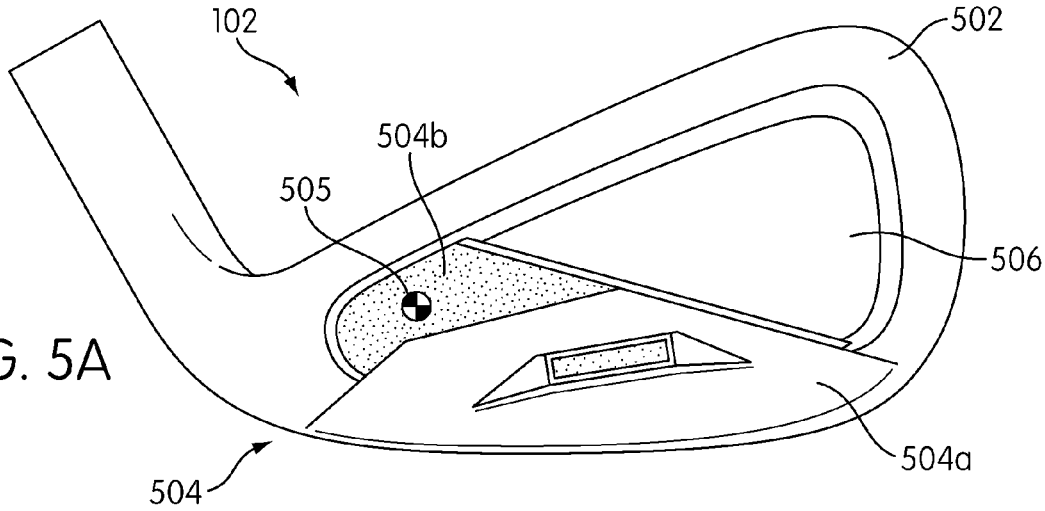
FIGS. 5A-5C illustrate a golf club head structure according to at least some examples of this disclosure.
Figure 5B:
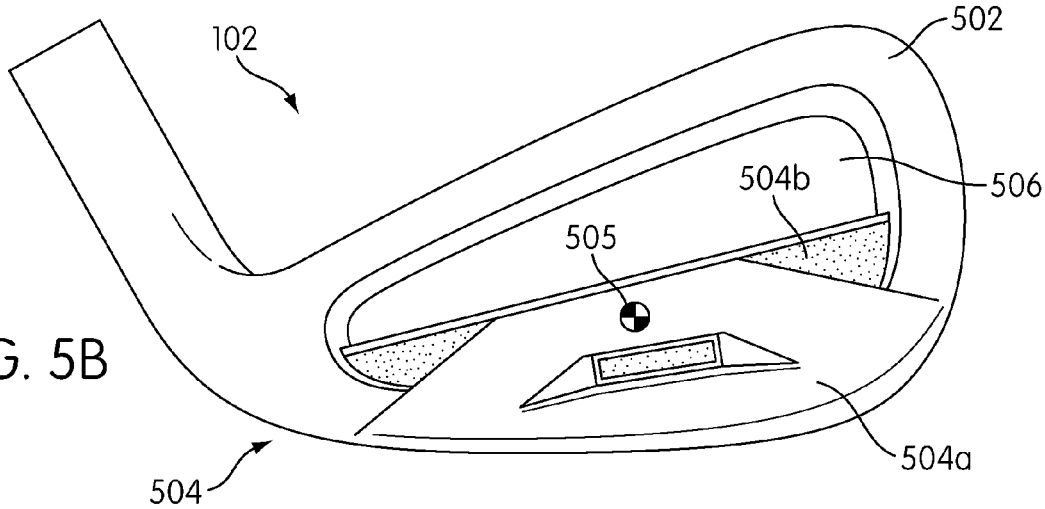
Figure 5C:
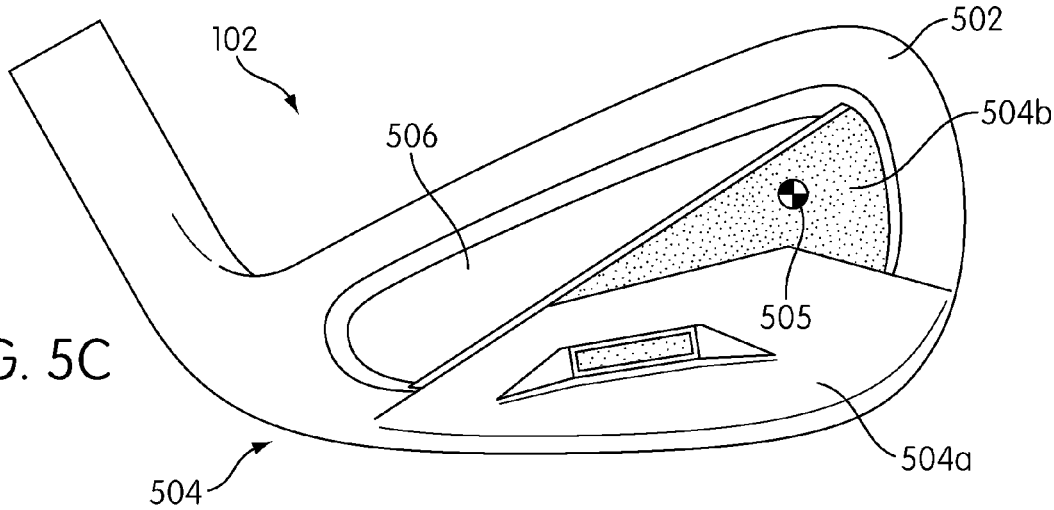

As seen in FIGS. 5A-C, the golf club head body 102 may include a perimeter weighting member 502. As shown in FIGS. 5A-C, the perimeter weighting member 502 may extend rearwardly from the ball striking face 102*a* and along at least a portion of a circumferential area of the golf club head body 102. Further, according to aspects of this disclosure, the golf club head body 102 may include a weight member 504 which redistributes the mass and weight of the golf club head body 102. According to some aspects of this disclosure, the member 504 may include a first portion and a second portion. In the depicted embodiment, the first portion is a bridge member 504*a* and the second portion is a mass member 504*b*.

The bridge member 504*a* may be either a portion of the perimeter weighting member 502 of the golf club head body 102 or a separate element(s) (e.g., made from the same or different materials as the perimeter weighting member) that is attached to the perimeter weighting member 502. According to some aspects of this disclosure, the bridge member 504*a* may be formed with the golf club head body 102. For example, during manufacture of the golf club head body 102, the golf club head body including the bridge member 504*a* could be formed (e.g., in a mold). Regardless of whether it is formed or attached, the bridge member 504*a* may be positioned at least along the top, bottom or side portions of the perimeter weighting member 502 and may form a substantial portion of at least one of the top, bottom or side of the perimeter weighting member 502. In the depicted embodiment, the bridge member 504*a* extends from the heel portion of the club head body 102 across a cavity 506 in the rear portion of the club head body 102 to the toe portion of the club head body 102.

According to some aspects of this disclosure, the mass member 504*b* may be either a portion of the bridge member 504*a* or a separate element (e.g., made from the same or different materials as the bridge member 504*a*) that is attached to the bridge member 504*a*. In such structures the mass member 504*b* may be positioned at least along the side of the bridge member 504*a* that is closest to the rear face of the golf club head body 102 so that the mass member 504*b* occupies at least some space in the cavity 506 of the golf club head body 102. In the depicted embodiment, the mass member 504*b* extends out beyond at least a portion of the bridge member 504*a* so that the mass member 504*a* is visible.

According to some aspects of this disclosure, the shape of weight member 504 (including the shape of the bridge member 504*a* and the shape of the mass member 504*b*), the positioning of the weight member 504 (including the positioning of the bridge member 504*a* and the positioning of the mass member 504*b*) relative to the golf club head body, or both the shape and positioning of the weight member 504 can be used to alter (e.g., shift) the center of the gravity of the club head body 102. For example, due to the weight member's weighting characteristics (weight, density, etc.), the shape and/or the position of the weight member 504 with respect to the club head body 102 will redistribute the weight of the golf club head body 102 (as compared to the golf club head body 102 without the weight member 504) and thereby shift club head body's center of gravity 505. Therefore, the weight member 504 (including the portions that make up the weight member 504) can be selectively shaped and/or positioned to control features of the club head's center of gravity 505.

For example, FIGS. 5A-C illustrate golf club head bodies with different mass and weight distributions. FIG. 5A is an illustrative embodiment of a golf club head body 102 for a "long" iron (e.g., a 3-iron), FIG. 5B is an illustrative embodiment of a golf club head body 102 for a "middle" iron (e.g., a 5-iron), and FIG. 5C is an illustrative embodiment of a golf club head body 102 for a "short" iron (e.g., a 9-iron). As can be seen by comparing FIGS. 5A, 5B and 5C, the different golf club head bodies each have a different center of gravity (which is denoted symbolically by reference numeral 505).

In FIG. 5A, the weight member 504 is shaped and positioned so that distributes more mass and weight generally at the heel portion of the club head body 102. For example, with regard to the shape of the bridge member, as shown, the bridge member 504*a* extends from the heel end of the golf club head body 102 towards the toe end of the golf club head body 102, but tapers steeply as it approaches the toe end of the club head body 102 so that the bridge member 504*a* does not quite reach the toe end of the golf club head body 102. Therefore, the shape of the bridge member concentrates more mass and weight towards the heel of the golf club head body 102. Further, with regard to positioning, as shown, the bridge member 504*a* is positioned so that more than half of to be towards the heel of the golf club head body 102 (with respect to the center of club head body 102). In a sense, the bridge member 504*a* is "shifted" towards the heel of the golf club head body 102. Therefore, the positioning of the bridge member 504*a* with respect to the golf club head body 102 concentrates more mass and weight towards the heel of the golf club head body 102. Similarly, the mass member 504*b* is shaped and positioned to concentrate more mass and weight towards the heel of the golf club head body 102. For example, with regard to the shape of the mass member 504*b*, as shown, the mass member 504*b* has a trapezoidal shape which extends from the crown portion to a sole portion at a heel end portion of the cavity and, further, the mass member 504*b* includes a toe end edge which corresponds to the same steeply tapered slope of the bridge member 504*a*. Hence, as can be seen in FIG. 5A, the mass member 504*b* occupies a heel end portion of the cavity 506, but does not occupy a substantial amount of a toe end portion of the cavity 506. Therefore, the shape of the mass member 504*b* concentrates more mass and weight towards the heel of the golf club head body 102. Further, with regard to positioning, as shown, the mass member 504*b* is positioned to be adjacent a heel side of the cavity 506 and, further, a majority of the mass member 504*b* is in the heel side half of the cavity 506 (with respect to the center of club head body 102). Therefore, the positioning of the mass member 504*b* with respect to the golf club head body 102 concentrates more mass and weight towards the heel of the golf club head body 102. As can be seen in the figure, the center of gravity 505 is closer to the heel of the club head body (e.g., closer to the heel than the toe).

In FIG. 5B, the weight member 504 is shaped and positioned to distribute more mass and weight generally at the center of the club head body 102. For example, as shown, the bridge member 504*a* is shaped so that extends along the sole portion of the golf club head body 102 from the heel end of the golf club head body 102 to the toe end of the golf club head body 102. Therefore, the shape of the bridge member 504*a* evenly distributes the mass and weight of the golf club head body in the heel to toe direction. Further, because the ends of the bridge member 504*a* are tapered toward the center of the club head body 102, the bridge member 504 concentrates more mass and weight at the center of the club head body. Additionally, as shown, the bridge member 504*a* is positioned in the center of the golf club head body 102 (i.e., equidistant from a heel and toe end of the club head body). Therefore, the positioning of the bridge member 504*a* with respect to the golf club head body 102 concentrates more mass and weight towards the center of the golf club head body 102. Similarly, the mass member 504*b* is shaped and positioned so that it concentrates more mass and weight towards the center of the golf club head body 102. For example, as shown, the mass member 504*b* has a trapezoidal shape which extends from the heel end portion of the cavity to the toe end portion of the cavity and, further, extends about halfway up the cavity 506 from the sole portion of the cavity 506. Therefore, the shape of the mass member 504*b* concentrates more mass and weight in the center of the golf club head body 102. Further, as shown, the mass member 504*b* is positioned to be adjacent to both a heel side of the cavity 506 and a toe end side of the cavity. Therefore, the positioning of the mass member 504*b* with respect to the golf club head body 102 concentrates more mass and weight towards the center of the golf club head body 102. As can be seen in FIG. 5B, the center of gravity 505 is generally in the center of the club head body (e.g., equidistant from the heel and the toe).

In FIG. 5C, the weight member 504 is shaped and positioned to distribute more mass and weight generally at the toe portion of the club head body 102. For example, the shape and the positioning of weight member 504 (including both the bridge member 504*a* and the mass member 504*b*) in this arrangement is opposite of the arrangement shown in FIG. 5A. Specifically, as shown, the bridge member 504*a* extends from the toe end of the golf club head body 102 towards the heel end of the golf club head body, but tapers steeply as it approaches the heel end of the club head body 102 so that the bridge member 504*a* does not quite reach the heel end of the golf club head body 102. Further, the bridge member 504*a* is positioned so that more than half of it is towards the toe of the golf club head body 102 (with respect to the center of club head body 102). In a sense, the bridge member 504*a* is "shifted" towards the toe of the golf club head body 102. Therefore, the shape of the bridge member 504*a* and positioning of the bridge member 504*a* with respect to the golf club head body 102 concentrates more mass and weight towards the toe of the golf club head body 102. Similarly, the mass member 504*b* is shaped and positioned to concentrate more mass and weight towards the toe of the golf club head body 102. For example, as shown, the mass member 504*b* has a trapezoidal shape which extends from the crown portion to a sole portion at a toe end portion of the cavity and, further, the mass member 504*b* includes a heel end edge which corresponds to the same steeply tapered slope of the bridge member 504*a*. Hence, as seen, the mass member 504*b* occupies a toe end portion of the cavity 506, but does not occupy a substantial amount of a heel end portion of the cavity 506. Further, as shown, the mass member 504*b* is positioned to be adjacent to a toe side of the cavity 506 and, further, a majority of the mass member 504*b* is in the toe side half of the cavity 506 (with respect to the center of club head body 102). Therefore, the positioning of the mass member 504*b* with respect to the golf club head body 102 concentrates more mass and weight towards the heel of the golf club head body 102. As can be seen in the figure, the center of gravity 505 is closer to the toe of the club head body (e.g., closer to the toe than the heel).

Therefore, the shape and positioning of weight member 504 (including the shapes and positioning of both the bridge member 504*a* and the mass member 504*b*) can be manipulated to provide a center of gravity 505 which is closer to the heel of the club head body (e.g., closer to the toe than the heel), closer to the center of the club head body, closer to the toe of the club head body (e.g., closer to the toe than the heel), etc.

Further, the embodiments shown in FIGS. 5A-C, are golf club head bodies 102 of a set of golf clubs with different centers of gravity wherein the centers of gravity follow a progression similar to the schematically shown progression of FIG. 2D, wherein the progression begins as a 2-iron (one of the club head bodies with a low degree of loft relative to the set of club head bodies) with the center of gravity 505 located generally towards the lower heel end of the club head body 102 and continues from the lower heel towards the upper toe of the club head body 102 until the progression ends as a pitching wedge (one of the club head bodies with a high degree of loft relative to the set of club head bodies) with the center of gravity 505 located generally towards the upper toe end of the club head body 102.

It is noted, of course, that FIGS. 5A-C are examples of a set that represents merely one embodiment of a set of golf clubs according to this disclosure and other sets of golf clubs according to this disclosure may include other clubs, such as sand wedges, lob wedges, hybrids irons, etc. It is further noted that other desired progressions (e.g., from the toe in "long" irons to the heel in "short" irons) or arrangements may be provided without departing from this disclosure. Therefore, it is realized that the weight members 504 (including the bridge member 504*a* and the mass member 504*b*) may be shaped, positioned, arranged, etc. in the golf club head bodies 102 of a set of golf clubs in a variety of different manners, orientations, and the like without departing from this disclosure.

As discussed above, the different locations of the center of gravity of the club head bodies can affect the trajectory and ball flight of a golf ball struck by the golf club. Therefore, according to some aspects of this disclosure, in a set of golf clubs wherein each golf club head body has a different center of gravity, the weight member 504 (including the bridge members 504*a* and the mass members 504*b*) for each golf club head body 102 may be different (e.g., a differently shaped element) and/or positioned differently in order to provide the different location of the center of gravity of each particular golf club head body in the set. Hence, it is understood that shaping and positioning the weight members 504 (including the bridge member 504*a* and the mass member 504*b*) that the in the golf club head bodies 102, progressively as shown in FIG. 5A-C will therefore produce a set of golf clubs with desirable characteristics. For example, the configuration of FIG. 4A decreases the distance from the hosel to the center of gravity. Therefore, a "long" iron of such a set of golf clubs has a club head body with a center of gravity near the hosel. Hence, as discussed above, such "long" irons can aid a golfer in imparting a "draw" trajectory to the golf ball and, therefore, provide characteristics of a "draw" shot (i.e., less backspin, further roll and lower ball flight) which will tend to increase the distance that the golf ball will travel upon being struck by the golfer. Conversely, the configuration of FIG. 5C increases the distance from the hosel to the center of gravity 505. Therefore, a "short" iron of such a set of golf clubs has a club head body with a center of gravity 505 near the toe. Hence, as discussed above, such "short" irons can aid a golfer in imparting "fade" trajectory to the golf ball and, therefore, provide characteristics of a "fade" shot (i.e., more backspin, less roll and higher ball flight) which tend to provide enhanced ball control (e.g., stopping the ball on the green).

It is noted that the weighting features of golf club head bodies in accordance with this disclosure are not limited to controlling the horizontal position of the golf club's center of gravity (the horizontal position when the golf club is oriented at a ball addressing position). Instead as discussed above with regard to previous embodiments, the center of gravity in the vertical direction also may be selectively controlled, if desired, in at least some examples of golf club head structures according to this disclosure (e.g., by the upper or lower portion of the mass member 504*b* being made heavier to lighter.

It is noted that the weighting features of golf club head bodies in accordance with this embodiment of the disclosure are not limited to controlling the horizontal or vertical position of the golf club's center of gravity. Instead, as discussed above in regard to the previously described embodiments, aspects of this disclosure relate to configuring the golf club head so that the center of the center of gravity of the club head body 102 is moved in a depth direction.

Figure 5D:
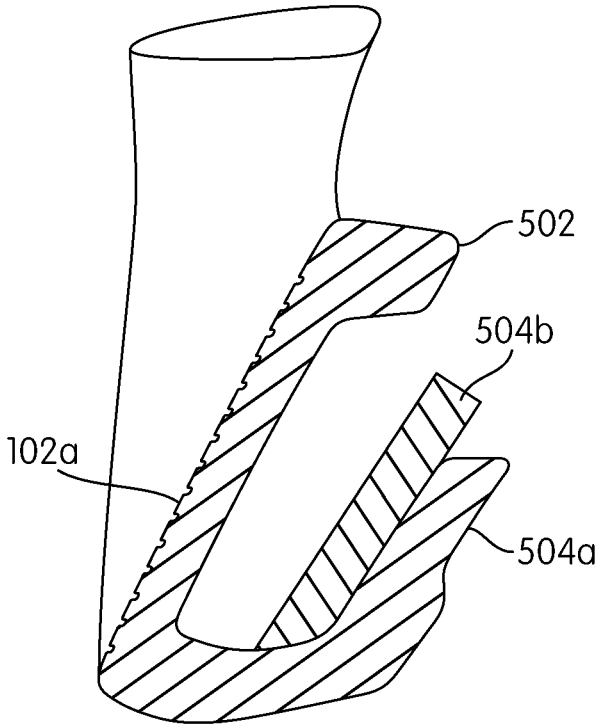
FIG. 5D illustrates a cross sectional view of golf club head structure according to at least some examples of this disclosure.
Figure 5E:
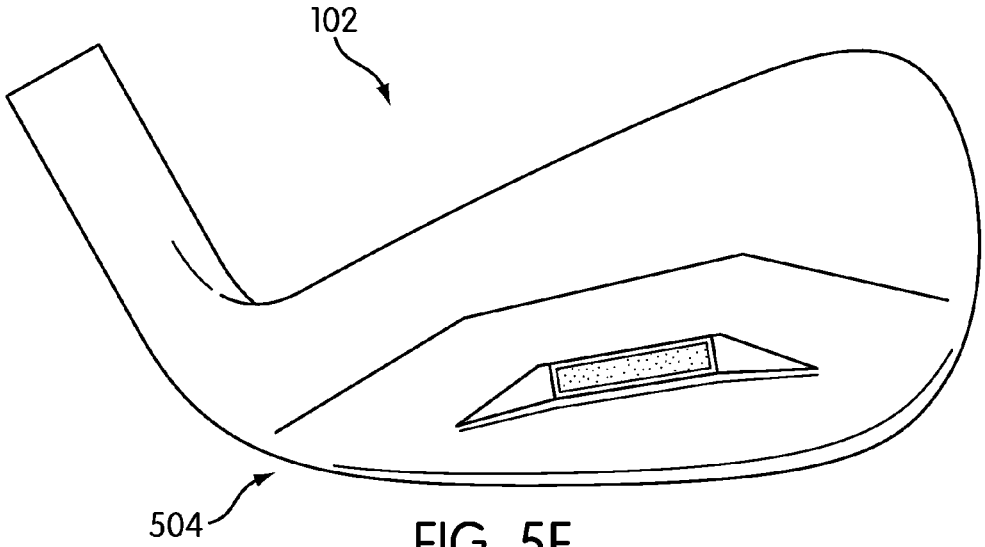
FIG. 5E illustrates a golf club head structure according to at least some examples of this disclosure.

For example, according to some aspects of this disclosure, the weight member 504 can be positioned away from the face of the golf club head body 102. For example, the weight member 504 may extend from the heel, toe, sole or crown of the golf club head body 102. FIG. 5D shows a cross-sectional view of an illustrative embodiment of the disclosure wherein the weight member 504 extends from the toe, heel and sole of the golf club head body 102 and, therefore, is positioned separate and away from the rear surface of the face of the golf club head body 102 defined by the cavity 506. By positioning the weight member 504 away from the face of the golf club head body 102, the center of gravity of the golf club head body 102 can be shifted away from the face of the golf club head body 102. Further, the position of the center of gravity 505 in the depth direction can be controlled as described above in regard to other embodiments of this disclosure (e.g., by making the mass member 504*b* thicker or by widening the depth, D, of the portion of the golf club head body from which the weight member extends, e.g., the sole portion 104*d*). Additionally, since such features are described in detail above, for the sake of brevity they will not be further elaborated on here.

Further, as discussed above in regard to the previously described embodiments, according to some aspects of this disclosure, the weight member 504 (including either the bridge member 504*a* or the mass member 504*b*) may have the same or different weighting characteristics (e.g., a different density, a different weight distribution, etc.) as the perimeter weighting member 502 or other portions of the club head body 102. For example, the mass member 504*b* may be made heavier as compared to the other parts of the golf club head (e.g., by forming the mass member 504*b* from a different material than the other parts of the golf club head body 102 or by including a weighted mass, such as lead or tungsten containing material, etc. in the mass member 504*b*). Further, it is noted that, different sections or portions of the perimeter weighting member 502 may also have a different weight, a different density, a different weight distribution, and/or other different weighting characteristics than other sections or portions of the perimeter weighting member 502. Additionally, since such weighting features are described in detail above, for the sake of brevity they will not be further elaborated on here.

Further, similarly to the previously described embodiments, according to some aspects of this disclosure, the shaping of the weight member 504 (including either the bridge member 504*a* or the mass member 504*b*) and the positioning of the weight member 504 (including either the bridge member 504*a* or the mass member 504*b*) relative to the golf club head body 102 may generally indicate the golf club head body's center of gravity 505 and/or distinguish between different golf club head bodies 102. For example, the "long" irons or a set of golf clubs may have mass members 504*b* which extend beyond the bridge members 504*b* at a heel side of the golf club head body while "short" irons may have mass members 504*b* which extend beyond the bridge members 504*b* at a toe side of the club head body. In this way the weight members 504 will indentify the golf club as a "long" iron and distinguish it from, for example, a "short" iron of the set. In addition to the shape, positioning and orientation of the weight member 504 distinguishing the club, other different visual indicators, such as colors, could be used in conjunction with the weight members 504 to further indentify and distinguish golf clubs from each other (e.g., the mass members 504*b* [or portions thereof, such as portions that extend beyond the bridge member 505*a*] can be selectively colored to indicate particular features of a club head body).

Therefore, it can be seen that according to aspects of this disclosure, the weight member 504 can be selectively shaped and/or selectively positioned to redistribute the mass and weight of the golf club head body 102 in order to shift the club head body's center of gravity 505 to a desired position (e.g., in the horizontal, vertical and/or depth direction), and also, if desired, generally indicate the location of the center of gravity of the golf club head body and/or distinguish the golf clubs from other in the set.

Any type of iron type golf club head structure may include weight members of the types described above (e.g., 204, 304, 404, 504, etc.), including, for example: iron type hybrid clubs, driving irons, 0-10 irons, wedges (e.g., iron type clubs having lofts from 44-68 degrees, such as pitching wedges, lob wedges, sand wedges, gap wedges, etc.), chipping clubs, etc. If desired, in accordance with at least some examples of this disclosure, golf clubs and/or golf club heads in accordance with examples of this disclosure may be sold or marketed as a set including plural irons, including, for example, sets having two or more of iron type hybrid clubs, driving irons, 0-10 irons, pitching wedges, lob wedges, sand wedges, gap wedges, and/or chipping clubs. When present in a set, any desired number of the clubs in the set may have a club head with a weight member in accordance with this disclosure. In some more specific examples, sets of golf clubs in accordance with this disclosure may contain at least the 3-9 irons and a pitching wedge, wherein at least 2 of these irons (and in some examples, all of these irons) will have a club head with a weight member in accordance with examples of this disclosure. As another example, sets of golf clubs in accordance with this disclosure will contain at least the 4-9 irons (or even 5-9 irons or 6-9 irons) and a pitching wedge, and optionally a sand wedge and/or one or more iron type hybrid clubs, wherein at least 2 of these clubs (and in some examples, all of these clubs) will have a club head with a weight member in accordance with examples of this disclosure.

Iron type golf club heads including weight members in accordance with examples of this disclosure are not limited for use with perimeter weighted and/or cavity back type clubs of the types illustrated in FIGS. 1-5. Rather, if desired, weight members may be provided (e.g., in similar positions and/or arrangements) in blade type iron clubs or other iron type golf club head structures without departing from this disclosure. FIG. 5E is an illustrative embodiment of such a blade type iron club. As can be seen in FIG. 5E, rather than forming a portion of a perimeter weight member, in blade type clubs, the weight members may be located in at least one of the upper rear portion of the back side of the club, the lower rear portion of the rear portion of the back side of the club, the club sole, etc.

Further, for example, it is noted that the specific weight members discussed in detail above are merely examples of weight members that may be used in accordance with this disclosure and are not meant to constitute an exhaustive list. On the contrary, these illustrative examples are simply intended to provide the reader with a better understanding of the disclosure.

III. Conclusion

The present disclosure is described above and in the accompanying drawings with reference to a variety of example structures, features, elements, and combinations of structures, features, and elements. The purpose served by the disclosure, however, is to provide examples of the various features and concepts related to the disclosure, not to limit the scope of the disclosure. One skilled in the relevant art will recognize that numerous variations and modifications may be made to the embodiments described above without departing from the scope of the present disclosure, as defined by the appended claims. For example, the various features and concepts described above in conjunction with FIGS. 1 through 5 may be used individually and/or in any combination or sub-combination without departing from this disclosure.

We claim:

1. A set of iron type golf clubs comprising at least two iron type golf clubs including a 9-iron club with iron type golf club head bodies wherein each of the iron type golf club head bodies has a different center of gravity, each of the iron type golf club head bodies includes a ball striking face, a crown portion, a sole portion, a heel portion, a toe portion and a rear surface opposite the ball striking face including a perimeter weighting member extending rearward from the ball striking face and along at least a portion of a circumferential area of the golf club head body, a cavity in the rear portion of the golf club head body, and a weight member which is selectively shaped to provide the respective center of gravity of each golf club head body at a particular position, wherein each of the weight members includes:

a base portion that extends from the perimeter weighting member, an upper heel side portion that extends from the base portion, and an upper toe side portion which extends from the base portion, wherein the shape of the weight members varies successively throughout the set of the golf clubs to shift the center of gravity from a position closer to the heel in club head bodies with a low degree of loft relative to the set of club head bodies to a position closer to the toe for club head bodies with a high degree of loft relative to the set of club head bodies, wherein the weight member extends from the perimeter weighting member into a cavity in the rear portion of the golf club head body and is positioned in the cavity of the golf club head body separate and away from a rear surface of the golf club head body defined by a cavity in a rear portion of the golf club head body, wherein a thickness of the upper heel side portion and a thickness of the upper toe side portion varies throughout the set of the golf clubs to shift the center of gravity from a position closer to the heel in club head bodies with a low degree of loft relative to the set of club head bodies to a position closer to the toe for club head bodies with a high degree of loft relative to the set of club head bodies, wherein the distance between the weight member and the respective face of the golf club head varies throughout the set of the golf clubs to shift the center of gravity towards or away from the respective face of the golf club head.

2. A set of iron type golf clubs according to claim 1, wherein each weight member of the set extends from its respective perimeter weighting member at the same relative location.

3. A set of iron type golf clubs according to claim 1, wherein weight members in club head bodies with a low degree of loft are shaped so that a majority of the weight member is in a heel side half of the cavity and weight members in club head bodies with a high degree of loft are shaped so that a majority of the weight member is in a toe side half of the cavity.

4. A set of iron type golf clubs according to claim 3, wherein the shape of the weight members varies successively in the heel to toe direction so that weight members in club head bodies with a low degree of loft are shaped so that the base portion of the weight member is directed toward the heel side of the golf club head body and weight members in club head bodies with a high degree of loft are shaped so that the base portion of the weight member is directed toward the toe side of the golf club head body.

5. A set of iron type golf clubs according to claim 1, wherein the weight member extends from the perimeter weighting member into a cavity in the rear portion of the golf club head body and is positioned in the cavity of the golf club head body separate and away from a rear surface of the golf club head body defined by a cavity in a rear portion of the golf club head body.

6. A set of iron type golf clubs according to claim 1, wherein the weight member is selectively removable from the golf club head body.

7. A set of iron type golf clubs according to claim 1, wherein the perimeter weighting member includes a weight receiving portion that allows the perimeter weight member to receive various interchangeable weight members which attach to the perimeter weight member via the weight receiving portion.

8. A set of iron type golf clubs according to claim 1, wherein the weight member has a density that is greater than the density of at least a portion of the perimeter weighting member.

9. A set of iron type golf clubs according to claim 1, wherein the weight member includes a color that contrasts from a color of the rear surface of the club head body defined by the cavity.

10. A set of iron type golf clubs according to claim 1, wherein the weight member has a T-shape.

11. A set of iron type golf clubs according to claim 1, wherein a taper of the upper heel side portion and a taper of the upper toe side portion varies throughout the set of the golf clubs to shift the center of gravity from a position closer to the heel in club head bodies with a low degree of loft relative to the set of club head bodies to a position closer to the toe for club head bodies with a high degree of loft relative to the set of club head bodies.

12. A set of iron type golf clubs according to claim 1, wherein an angle at which the weight member extends towards or away from the respective face of the golf club head varies throughout the set of the golf clubs to shift the center of gravity towards or away from the respective face of the golf club head.

* * * * *